US005765923A

United States Patent [19]

Watson et al.

[11] Patent Number: 5,765,923

[45] **Date of Patent: *Jun. 16, 1998**

[54] CARTRIDGE FOR GENERATING HIGH-PRESSURE GASES IN A DRILL HOLE

[75] Inventors: John David Watson, Evergreen, Colo.; Paul Michael Krogh, Fremont, Calif.

[73] Assignee: Sunburst Excavation, Inc., Denver, Colo.

[ * ] Notice: The term of this patent shall not extend beyond the expiration date of Pat. No. 5,308,149.

[21] Appl. No.: 484,411

[22] Filed: Jun. 7, 1995

Related U.S. Application Data

[63] Continuation-in-part of Ser. No. 153,977, Nov. 18, 1993, abandoned, which is a continuation-in-part of Ser. No. 894,604, Jun. 5, 1992, Pat. No. 5,308,149.

[51] Int. Cl.[6] ..... F21C 37/14; F42D 3/04

[52] U.S. Cl. ..... 299/13; 102/313; 102/430; 102/530; 175/2

[58] Field of Search ..... 299/13, 16; 175/2; 166/63; 102/313, 324, 323, 322, 202, 430, 469, 470, 530, 531, 314, 331

[56] References Cited

U.S. PATENT DOCUMENTS

| | | | |
|---|---|---|---|
| 1,189,011 | 6/1916 | Smith . | |
| 2,587,243 | 2/1952 | Sweetman | 102/24 |
| 2,928,319 | 3/1960 | Sokolowski | 89/1 |
| 3,003,419 | 10/1961 | Fite | 102/86.5 |
| 3,144,827 | 8/1964 | Boutwell | 102/39 |
| 3,182,595 | 5/1965 | Hassmann | 102/86.5 |
| 3,307,445 | 3/1967 | Stadler et al. | 86/20 |
| 3,313,234 | 4/1967 | Mohaupt | 102/20 |
| 3,386,769 | 6/1968 | Wilmeth | 299/70 |
| 3,435,765 | 4/1969 | Gawlick | 102/39 |
| 3,604,355 | 9/1971 | Greenlees | 102/39 |
| 3,641,935 | 2/1972 | Gawlick et al. | 102/39 |
| 3,756,763 | 9/1973 | Elmore et al. | 431/1 |
| 4,064,935 | 12/1977 | Mohaupt | 166/63 |
| 4,394,051 | 7/1983 | Oudenhoven | 299/16 |
| 4,530,396 | 7/1985 | Mohaupt | 166/63 |
| 4,669,383 | 6/1987 | Penner | 102/202 |
| 4,688,465 | 8/1987 | Melhus et al. | 86/20.14 |
| 4,798,244 | 1/1989 | Trost | 102/313 X |
| 4,809,612 | 3/1989 | Ballreich et al. | 102/466 |
| 5,005,641 | 4/1991 | Mohaupt | 166/63 |
| 5,033,390 | 7/1991 | Minert et al. | 102/530 |
| 5,069,130 | 12/1991 | Buckley et al. | 102/202 |
| 5,098,163 | 3/1992 | Young, III | 299/13 |
| 5,308,149 | 5/1994 | Watson et al. | 299/13 |

FOREIGN PATENT DOCUMENTS

| | | | |
|---|---|---|---|
| 288654 | 4/1920 | Germany . | |
| 942750 | 12/1959 | United Kingdom | 299/13 |
| 911896 | 11/1962 | United Kingdom . | |

*Primary Examiner*—Hoang C. Dang
*Attorney, Agent, or Firm*—Sheridan Ross P.C.

[57] ABSTRACT

The present invention is directed to a cartridge for use in fracturing materials, such as rock. The cartridge includes a base member, a body member, a propellant, and a device for sealing a surface of the cartridge to the surface of a hole in the material. Upon ignition of the propellant, gas pressure rapidly rises in the hole due to the sealing device. The gas pressure causes the material to form a penetrating cone fracture. Various cartridge configurations are presented depending upon the specific needs of each application.

24 Claims, 16 Drawing Sheets

CARTRIDGE FOR GENERATING HIGH-PRESSURE GASES IN A DRILL HOLE

REFERENCE TO RELATED APPLICATIONS

The present application is a continuation-in-part of U.S. patent application Ser. No. 08/153,977 for "Method and Means of Generating High-Pressure Gases in a Drill Hole with a Low-Cost Cartridge", filed Nov. 18, 1993, now abandoned which is incorporated herein by reference in its entirety and which is a continuation-in-part of U.S. patent application Ser. No. 07/894,604 for "Non-Explosive Drill Hole Pressurization Method and Apparatus for Controlled Fragmentation of Hard Compact Rock and Concrete", filed Jun. 5, 1992, (now U.S. Pat. No. 5,308,149).

BACKGROUND OF THE INVENTION

The following describes a versatile, low-cost method and means for generating high-pressure gases in the bottom of a drill hole for the purpose of controlled fragmentation of rock.

This method and means is classed as a non-explosive process for generating high-pressure gases as opposed to a detonation process such as with high explosives. This method and means of generating high-pressure gases is also much more dynamic and capable of generating higher pressures than mechanical or hydraulic methods of generating pressures in a drill hole. The regime of operation between explosive and mechanical/hydraulic is possible because of the use of propellants as the prime source of energy. Propellants have energy densities approximately the same as high explosives (3400 to 5000 Joules per kilogram) and are substantially more compact than any other prime energy source other than nuclear. Propellants are distinguished from high-explosives by their ability to burn controllably. High-explosives, once initiated, burn by detonation in which a supersonic detonation wave moves at constant velocity through the unburned material. It is characterized by strong shock waves. Propellants burn subsonically by a process called deflagration. The burning rate can be controlled by geometry and pressure, to generate pressures within a desired range. Burning can be rapid but slow enough to avoid generation of strong and destructive shock waves.

A propellant-containing cartridge is a key component in a controlled rock fragmentation method currently under development. This process is referred to as the PCF method ("Controlled Fracture Method and Apparatus for Breaking Hard Compact Rock and Concrete Materials" U.S. Pat. No. 5,098,163, 24 Mar. 1992). In this method of breaking rock, a short hole is drilled into the rock. Controlled fragmentation is carried out by either of two apparatuses. In the first, a gun-like device called a gas-injector is used. Here an extractable cartridge is loaded into the combustion chamber of the gas-injector and the barrel of the gas-injector is inserted to the bottom of the drill hole. The propellant is burned in the combustion chamber and the resulting hot gases are directed to the hole bottom by the barrel of the gas-injector. After being fired, the cartridge is extracted from the combustion chamber of the gas-injector and discarded. In the second apparatus, a cartridge containing a propellant charge is inserted directly in the hole bottom and stemmed (tamped) in the drill hole by a massive stemming bar which is in contact with the cartridge. In this embodiment, the expended cartridge remains with the broken rock and therefore need not be extracted.

The result of burning the propellant in both apparatuses is to apply a controlled pressure to the hole bottom which then initiates and drives controlled fractures into the rock. One of the primary features of this process, as compared to blasting with explosives, is the low energy and benign nature of the resultant broken rock which is called flyrock. This feature allows this method of breaking rock to be applied as a continuous excavation process with the apparatus remaining at the work face during the fragmentation phase of the excavation cycle. Another important feature of this method is the absence of strong shocks such as are present in blasting with high-explosives. Because of this feature, the rock remaining in place suffers far less blast damage, and much less dust or fines are produced.

SUMMARY OF THE INVENTION

An essential requirement of a successful rock breaking process is cost-control of the expendable items used repetitively in the process. In the above-mentioned controlled fragmentation process, the cartridge and propellant are the principal expendables. The amount and type of propellant used in each shot is dependent on the rock conditions. A massive, high-strength rock may require a relatively large load of slow burning propellant, whereas a highly fractured rock of medium strength may require a light fast-burning propellant. Further, to access a low-cost propellant supply such as surplus domestic or foreign propellants, the choice of propellants may be limited. It is therefore desirable to have a means of adapting to different rock conditions and propellants, that does not require a new cartridge design with every change of propellant. Frequent changes in cartridge design would involve additional capital costs for tooling and molds, additional inventory costs for the various cartridge designs, and additional research costs for cartridge and charge development.

The present invention envisions the use of an igniter tube design that can be modified to: initiate different propellant types; adapt to various additives if required; burn different propellant charge weights to the desired pressures and; be used in a single low-cost cartridge design. The overall development and manufacturing costs of an igniter tube are a small fraction of the costs (a few percent) of either the entire cartridge or propellant and this represents the low-cost control element that is sought.

An igniter tube is a control element to enable the controlled, high-pressure burning of a variety of propellants, propellant additives and propellant weights in a single low-cost cartridge design. The cartridge is an expendable item in a rock-breaking apparatus which relies on the controlled generation of high-pressure gases at the bottom of a drill hole. The cartridge is inserted into the breech mechanism of a gas-injector and the propellant is initiated by a primer which, in turn, initiates the powder in a long igniter tube which, in turn, ignites the main propellant load. The gases resulting from the burning of the propellant are directed down a barrel inserted into the drill hole, to pressurize the hole bottom and initiate a controlled-fracture fragmentation of the rock. The expended cartridge is then extracted from the gas-injector. Alternately, the cartridge can be inserted directly into the bottom of the drill hole and stemmed with a heavy inertial bar. In both methods, the front end of the propellant load may be substantially unconfined, making it difficult to burn rapidly to the high pressures (100 MPa to 400 MPa) required to break rock. The igniter tube which is inserted along the axis of the propellant load in the cartridge contains either black powder or a synthetic black powder or some other pyrotechnic composition. The mass and/or distribution of the igniter powder may be varied to control ignition of the main propellant load. The number of flash holes, diameter of flash holes and positioning of flash holes may all be varied to cause the desired burning of the main propellant load in the absence of significant front end confinement (such as provided by the projectile in a gun application).

For these rock breaking applications, it may be required to:

1. burn different propellant charge masses
2. burn to different peak pressures depending on rock strength
3. utilize different types of low-cost propellants depending on availability
4. adjust burn characteristics to accommodate the addition of oxidizing agents such as ammonium nitrate to reduce or eliminate excess carbon monoxide which must be controlled in an underground operating environment
5. use a single cartridge design to minimize manufacturing and inventory costs The main attribute of the present invention is the use of an appropriately designed igniter tube, which can be redesigned and manufactured for a low cost compared to the entire cartridge, to control the burning of the main propellant load under the above variety of requirements in a single cartridge design.

An additional important advantage of the present invention is that by better controlling the burn characteristics of the propellant charge, rock fragmentation can be further and substantially optimized over present practice. The operator plays an important role in a small-charge, controlled-fragmentation method of excavating rock. Shots are made every few minutes and each shot may be significantly different as a result of the varying rock properties and/or topology of the rock face. Substantial variation in burning characteristics from shot to shot, such as caused by initiating the main propellant load by a single primer at the base of the charge (referred to as single point ignition), can cause the operator to misjudge the depth and placement of subsequent shots thereby reducing the overall efficiency of this method of breaking rock. Reduced efficiency of breakage also enhances unwanted by-products of the method such as increased air-blast, increased generation of carbon monoxide or other byproduct combustion gases, and increased energy of flyrock. Without the control afforded by even a simple igniter tube, shot-to-shot variation can arise from variations in ambient operating temperatures which affect ignition characteristics of the main propellant load (some mining and tunneling environments are very hot, some are very cold). Shot-to-shot variations are also caused by variations in propellant lots, cartridge manufacturing tolerances, assembly and loading operations and by orientation of the cartridge during firing. The addition of an igniter tube, especially with the limited front-end confinement as envisioned in the present invention, will substantially reduce or eliminate the sensitivity to these types of variations.

The cartridge used in the rock fragmentation process consists of a base section and body. In the gas-injector apparatus, the base of the cartridge contains extractor grooves that allow an extractor mechanism to remove the cartridge from the gas injector after firing. In the direct cartridge insertion apparatus, the cartridge base contains grooves that can be gripped by the massive stemming bar to allow the cartridge to be inserted in the bottom of the drill hole. The cartridge body may or may not be integral with the cartridge base. If the body and base are separate parts, the body and base are attached by means of a snap groove mechanism or similar low-cost arrangement.

A small (usually commercially available) primer device is inserted in the cartridge base. This primer can initiate the base of the propellant load on its own but cannot provide the control over the initiation process of the entire length of the propellant load as required. The primer may be a percussive, electrical or optical primer activated by means of an ignition system external to the cartridge.

The primer can be used to initiate a fast, hot burning igniter powder that fills an igniter tube running along the axis of the cartridge. The flame produced by the igniter powder can be directed by the igniter tube to initiate the main propellant bed in the cartridge. The igniter tube can control the dispersion of this initiating flame to the main propellant bed by a variety of means.

These include:

varying the internal diameter of the igniter tube varying the length of the igniter tube varying the size and location of holes along the body of the igniter tube varying the composition of the igniter tube powder In the rock fragmentation application, the cartridge may not have the confinement provided by the presence of a projectile as occurs in a gun. In the gas-injector apparatus, the front-end of a rock-breaking cartridge is unconfined, whereas in a gun, the projectile provides a small mechanical (shot-start) and an inertial confinement that allows the propellant to build up pressure before it generates additional volume. Without this front-end confinement, it is more difficult to burn a propellant load to the required pressure levels. An igniter tube with the ability to distribute a flame throughout the main propellant bed and to preferentially initiate burning near the front of the propellant load allows the required burning to be achieved even without front-end confinement of the charge.

In the apparatus where the cartridge is inserted directly into the bottom of the drill hole, the cartridge carries the expansion volume, required to limit peak burning pressure, in the cartridge. Some front end confinement of the propellant load may be provided by the proximity of the bottom of the drill hole. When the cartridge is inserted directly into the drill hole, it is often not inserted all the way to the hole bottom. In these situations, the volume between the front end of the cartridge and the hole bottom may be filled with air or water. The above three possibilities introduce variability into the front-end confinement condition on the cartridge and therefore a means of reliably and controllably burning the propellant is again required. Even when front-end confinement is provided by the hole bottom, an igniter tube still provides important control over the burning process by controlling the rate of pressure rise which is important for controlling the rate of recoil and gas leakage (if any) with the rock-breaking cycle.

The present invention represents a method and means to obtain a significant improvement in control over the propellant burning process than is achievable with current cartridge design which does not use an igniter tube. This will lead to better process efficiency since the operator will not have to be concerned with propellant burn variability in addition to variability in rock conditions. It will also lead to a substantial improvement in the costs of applying controlled rock fragmentation through the use of propellants, by permitting the use of a wide variety of propellant charge weights, propellant types and additives with a single cartridge design.

A typical cartridge design for generating high-pressure gases for the controlled fragmentation of rock is shown in FIG. 1. The cartridge base is made from either a metal or a reinforced plastic and may contain gripping grooves required for insertion and extraction. In the case of a metallic cartridge base, it can be machined by an automated operation and can be used several times before it becomes inoperable, thereby keeping the per shot cost down. In the case of a plastic base, the part is expendable every shot, but can be injection molded at a low unit cost.

The cartridge body can be mass-produced by a low-cost plastic molding process. The front-end of the body is destroyed with each shot so this part cannot be reused.

The primer can be a percussive, electrical or optical primer and is destroyed with each shot.

An essential requirement of all three components (base, body and primer) is that they can be produced economically in large quantities.

In a typical application, the cartridge is loaded with available single or double base propellants. These can be obtained for reasonable cost either directly from a propellant manufacturer or from a supplier of surplus propellants. There is an enormous supply of surplus propellant available.

There is a substantial and even critical cost advantage to manufacturing a single cartridge base and body to operate under a variety of rock conditions and with a variety of propellant types, additives and charge masses.

With the present invention, this flexibility of operation can be accomplished by modifying the design of an igniter tube, which is a small component of the cartridge and represents a small cost item. The present invention is applicable to cartridges charged with either solid or liquid propellants.

The igniter tube is a small diameter (in relation to the cartridge diameter) tube that is aligned with the axis of symmetry of the cartridge. It is open on the base end to the primer pocket which contains the primer. The igniter tube may run partially or totally through the main propellant bed, depending on the type of control that is required. The igniter tube is filled with a flash powder such as black powder, a synthetic black powder or a suitable pyrotechnic. All of the igniter powders are characterized by the ability to be easily ignited by a primer and the ability to generate a hot flame capable of igniting a main propellant load that is considerably harder to initiate because of the chemical composition of the main propellant or the size of the granulation or because of inhibitors added for safety or to control grain burn rate. The igniter tube may be closed at the downstream end by a light cotton wad or tape to hold in the igniter charge. In this configuration the igniter charge can easily vent out the downstream end to ignite the front portion of the propellant load. Alternately, the igniter tube may be closed at the downstream end by mechanically pinching off the tube or by a means of a plug to prevent immediate ignition of the front portion of the propellant load.

The igniter tube can spread an igniting flame through the main body of propellant by shooting out small flame fronts through holes in the igniter tube body. The size or diameter of these holes dictates the intensity of the igniting flame fronts. The positioning and distribution of these holes dictates the distribution of ignition energy delivered to the main propellant load.

The burn rate of a propellant of a given grain geometry depends on the pressure of the combustion product gases and can be approximately described by the equation:

$$r=B\,p^n$$

where r=burn rate

B=burn rate constant p=pressure n=burn rate exponent

The burn rate exponent is in the range of 0.5 to 1.0 and is typically 0.8. The burn rate constant is a property of the propellant chemistry and propellant additives.

Generally, when burning a propellant in a controlled manner, the volume available to the propellant is increased as the propellant burns in order to control the pressure and prevent a runaway burn. In a gun, this volume is provided as the projectile accelerates down the gun tube. In the current application where there is little or no front-end confinement, the propellant must be burned quickly, but not too quickly as to run away, since, once the cartridge front-end is ruptured, there is unlimited volume available to the burning propellant. If the burn rate is too slow, the propellant gases will expand too quickly and the rapid pressure drop will extinguish the burn. The burn rate is expressed in terms of psi/millisecond and this accounts for both propellant properties and grain geometry. The preferred burn rate for most applications preferably ranges from about 20,000 to about 100,000, more preferably from about 30,000 to about 80,000, and most preferably from about 45,000 to about 65,000 psi/millisecond.

When the propellant is ignited by single point ignition using a primer in the cartridge base, it is impossible to achieve the desired repeatability of burning characteristics for a variety of propellant charge weights and propellant types. Generally, the cartridge design must be modified (for example to provide a confining wad or a front-end with different burst characteristics) to accommodate a change in propellant weight or type. Even so, burning characteristics remain sensitive to manufacturing tolerances, to variations in propellant loading procedures, to variations in operating temperatures and to orientation during firing.

In an embodiment of the igniter tube, the holes or perforations and the igniter tube are dimensioned to produce the above-noted burn rates. In this embodiment, the holes have a diameter ranging from about 0.30 to about 0.15, more preferably from about 0.50 to about 0.120, and most preferably from about 0.060 to about 0.090 inches. The spacing between adjacent holes preferably ranges from about 0.060 to about 0.50, more preferably from about 0.10 to about 0.36, and most preferably from about 0.15 to about 0.24 inches. The inner diameter of the igniter tube ranges from about 0.125 to about 0.50, more preferably from about 0.150 to about 0.300, and most preferably from about 0.175 to about 0.250 inches. The length of the igniter tube preferably ranges from about 1.00 to about 8.00, more preferably from about 1.50 to about 6.00, and most preferably from about 1.75 to about 4.00 inches. The igniter tube length thus preferably ranges from about 10 to about 90, more preferably from about 17 to about 67, and most preferably from about 20 to about 45% of the cartridge length, and the volume of the tube preferably ranges from about 0.044 to about 5.60, more preferably from about 0.095 to about 1.50, and most preferably from about 0.15 to about 0.70% of the cartridge volume.

DETAILED DESCRIPTION OF THE DRAWINGS

Figure 1:
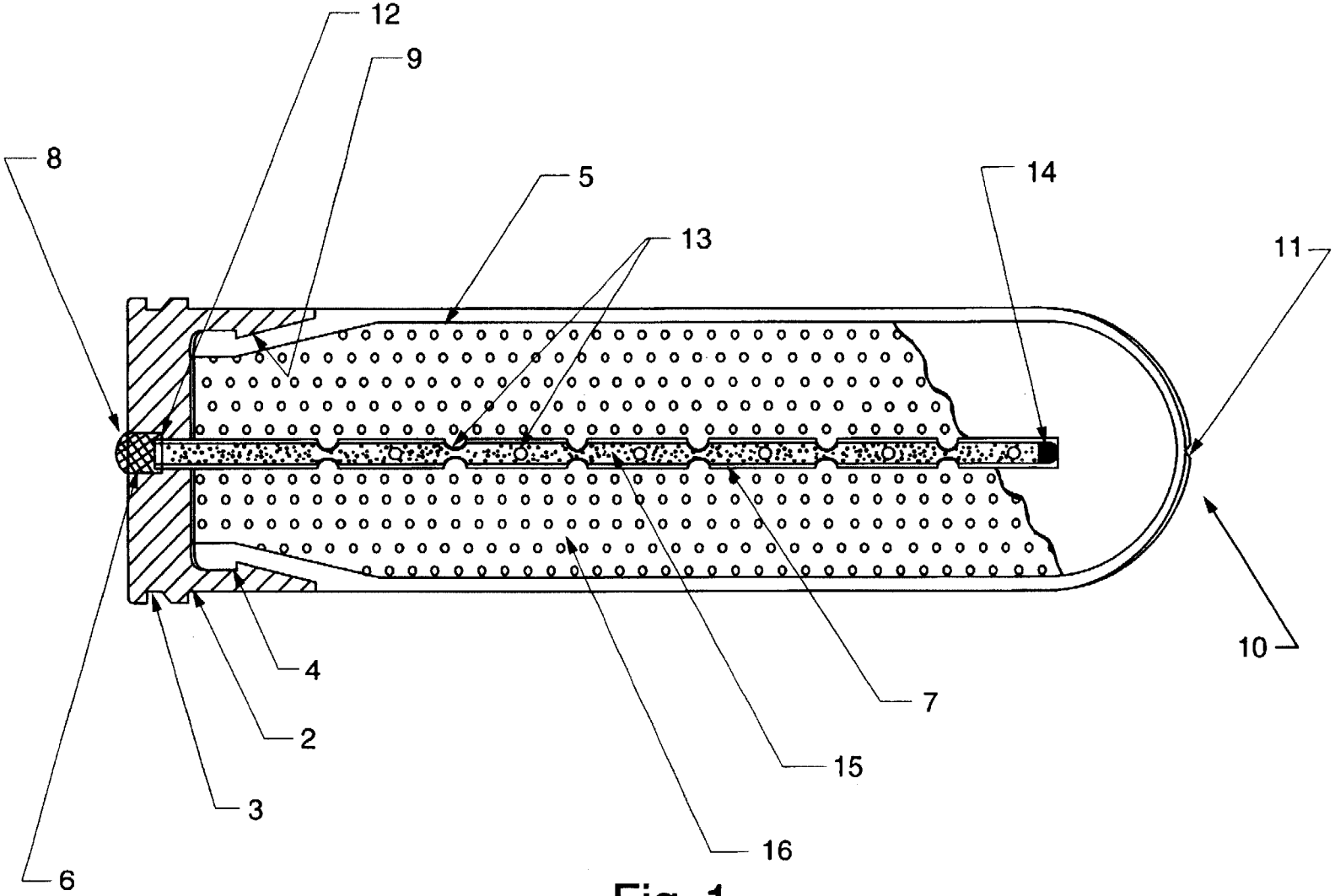
FIG. 1 shows a schematic sectional view of a cartridge used in a gas-injector.

FIG. 1 shows a schematic sectional view of a complete cartridge for gas-injector 1 that is used in a gas-injector (hereinafter referred to as "the injector cartridge"). The cartridge base 2 contains an external extractor groove 3 that can be gripped by a mechanism for inserting the cartridge into and extracting the cartridge from the combustion chamber. The cartridge base also contains an internal base snap groove 4 for removably attaching and retaining the cartridge body 5 to the cartridge base both for assembly and shipping and during firing and extraction. As discussed below, The internal base snap groove permits the cartridge body to be removably connected to the cartridge base, thereby enabling the cartridge base to be reused. The old cartridge body, igniter tube, and primer are simply removed from the cartridge base and discarded. To reuse the cartridge base, propellant is placed in the cartridge body or attached to the cartridge base, a new igniter tube and primer are attached to the cartridge base, and a new cartridge body is attached to the cartridge base. The cartridge base 2 also contains a primer pocket 6 which is concentric with the axis of rotation of She cartridge. The primer pocket allows the igniter tube 7 to be inserted and seated into the position shown. Thereupon, the primer 8, which has a slightly larger external diameter than the diameter of the primer pocket 6, is pressed into the position shown. The cartridge preferably has a length ranging from about 2.00 to about 12.00 inches, a maximum outer diameter ranging from about 1.50 to about 3.00, and a volume ranging from about 3.0 to about 40 $in^3$.

The cartridge body 5 is removably attached to and retained in the cartridge base 2 by a body snap groove 9. At the front end of cartridge body 10, the cartridge may have two or more shallow rupture grooves 11 which are scribed to facilitate the rupture of the cartridge front end as the gas pressure builds up inside the cartridge during firing. These grooves ensure that the cartridge ruptures at the front end and not elsewhere along the cartridge body such as the location near where the cartridge body 5 enters the cartridge base 2.

The percussive or electrical or optical primer 8 is pressed into the primer pocket 6 of the cartridge base 7 and seats on the primer seating rim 12 of the igniter tube 7.

The igniter tube 7 is a tube containing a number of flash holes 13 positioned in the walls of the igniter tube. The front end of the igniter tube may contain [a] an igniter tube plug 14 or it may contain a light wad which can contain the igniter powder 15 before firing but allow flame to be injected into the front of the main propellant bed 16 during firing.

A firing pin (not shown) is used to fire the primer 8. The primer initiates the igniter tube powder 15 which in turn initiates burning of the main propellant bed 16.

Figure 2:
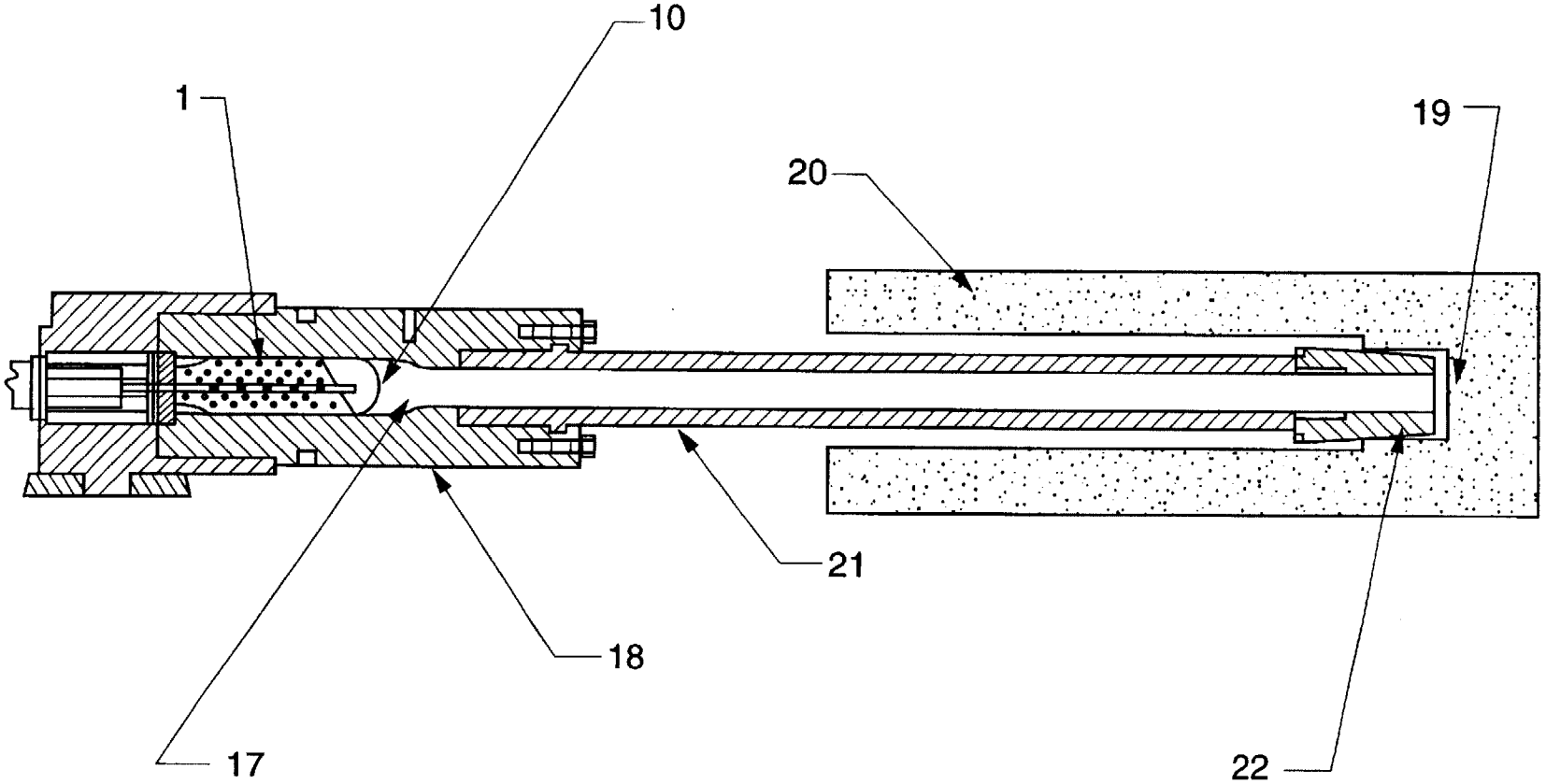
FIG. 2 shows a schematic sectional view of the cartridge of FIG. 1 loaded in the combustion chamber of a gas injector which is in turn shown in position for firing in a drill hole in the rock.

FIG. 2 shows a schematic sectional view of the cartridge for gas-injector 1 of FIG. 1 loaded in the combustion chamber 17 of a gas injector assembly 18 which is in turn shown in position for firing in a drill hole bottom 19 in the rock 20. The cartridge is fired in the position shown. As can be seen, the front end of cartridge 10 has no forward confinement other than the front walls of the cartridge. Once the pressure inside the cartridge builds up to a small fraction (typically 2% to 10%) of the peak combustion chamber pressure (which preferably ranges from about 20,000 to about 80,000 more preferably from about 30,000 to about 70,000, and most preferably from about 40,000 to about 60,000 psi) the front end of the cartridge body ruptures and there is no further confinement of the propellant gases during burning. The propellant gases expand down the gas-injector barrel 21 until they are reflected from the bottom of the drill hole 19. The propellant gases are prevented from escaping out of the closed volume formed by the gas-injector and drill hole bottom by a dynamic sealing action provided by the tapered sealing tip 22 of the gas-injector barrel. The pressures in the hole bottom required for rock fracturing typically range from about 40,000 to about 160,000 psi.

Figure 7:
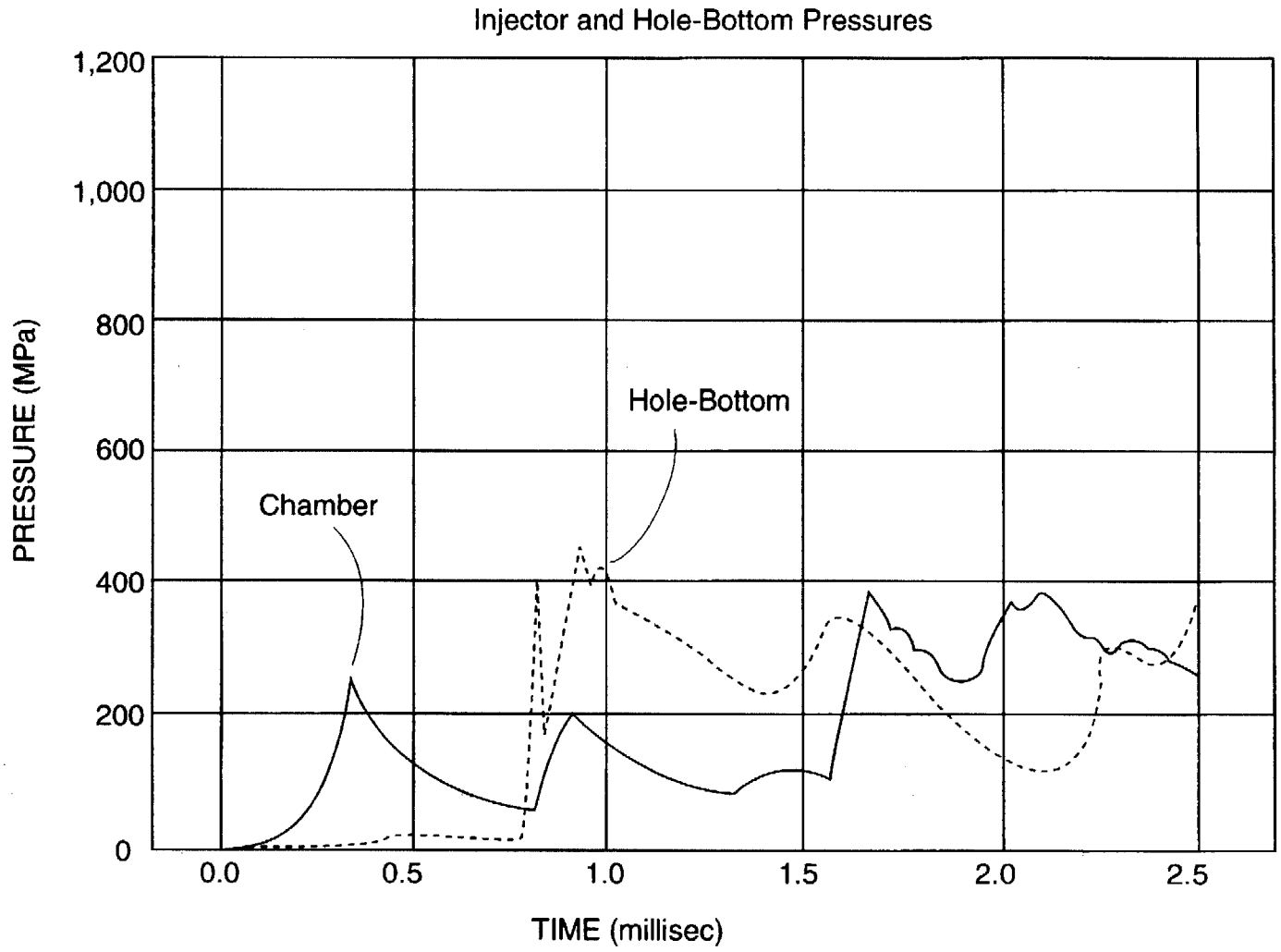
FIG. 7 and 8 illustrate calculated pressure histories of the prior art gas-injector system.

In operation, the cartridge is first loaded into the combustion chamber 17 and the gas injector barrel is placed into the drill hole. The firing pin (not shown) is actuated thereby triggering the primer 8 which in turn ignites the igniter powder 15, which in turn ignites the propellant. As the propellant burns, pressure builds up within the cartridge body 5. When the pressure is from about 400 to 2,000 and more preferably from about 800 to about 1,000 psi, the cartridge body 15 ruptures at the rupture groove 11 releasing the generated gas into the combustion chamber 17 and the barrel 21. The change in cross-sectional area of the gas injector barrel effectively slows the release of the gas into the barrel 21, thereby providing some degree of confinement. The cross-sectional area ratio of the combustion chamber 17 to the barrel 21 preferably ranges from about 16:1 to about 2:1. The change in cross-sectional area causes the rate of gas generation in the combustion chamber 17 to exceed the rate of gas loss from the combustion chamber into the barrel. Accordingly, a net pressure rise occurs in the combustion chamber 17 with the maximum pressure in the chamber preferably ranging from about 20,000 to about 80,000, more preferably from about 30,000 to about 70,000, and most preferably from about 40,000 to about 60,000 psi. The pressure in the drill hole bottom 19 rapidly builds up as gas moves down the barrel. FIG. 7 illustrates the pressure history in the drill hole bottom. When the pressure in the drill hole bottom is at least about 20% of the unconfined compressive strength of the rock, the rock 20 is fractured.

Figure 3:
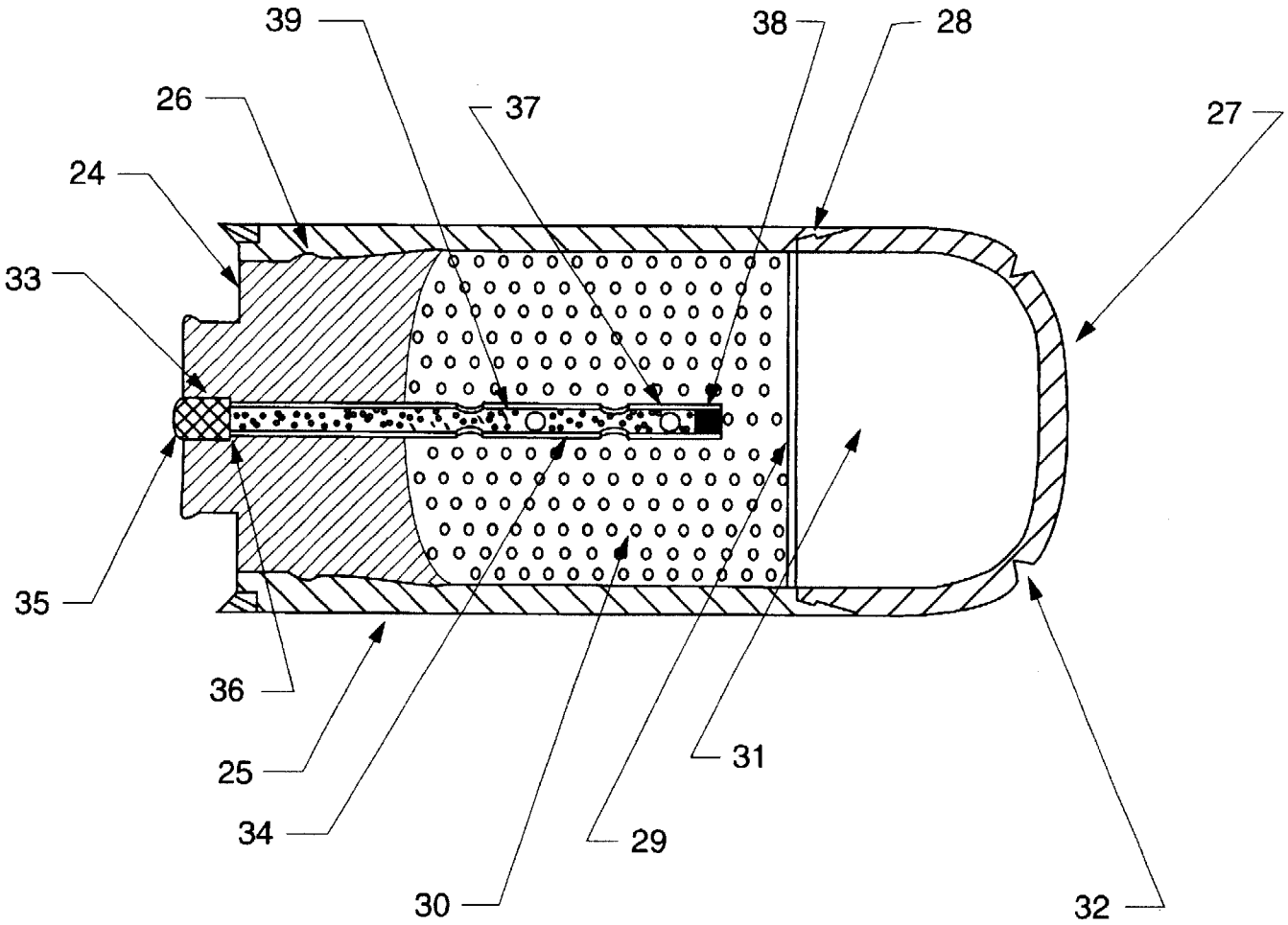
FIG. 3 shows a schematic sectional view of a cartridge used in a method of directly inserting the cartridge in the bottom of a drill hole.

FIG. 3 shows a schematic sectional view of a cartridge for hole bottom 23 used in a method of directly inserting the cartridge in the bottom of a drill hole (hereinafter called "the HBP cartridge"). The tapered cartridge base 24 is removably attached to the cartridge body 25 by a base snap groove 26 when not in use. The cartridge body 25 thus has a cylindrical exterior and a conical interior to match the conical shape of the cartridge base 24. The taper in the cartridge base and cartridge body interior preferably ranges from about 1.5 to about 6.0, more preferably from about 2.0 to about 4.0, and most preferably about 3.0 degrees. The tapered wall of the cartridge base is designed to expand to the drill hole wall without rupturing and form a seal, thus preventing the high pressure propellant gases from acting directly on the drill hole wall or in any fractures (natural or induced) along the hole wall behind the cartridge. When this cartridge is fired, the cartridge base 24 will begin to slide relative to the cartridge body and be displaced from the cartridge body 25 as it follows the recoil motion of the heavy stemming bar (shown in FIG. 4) which provides inertial containment of the cartridge in the bottom of a drill hole. The cartridge body 25 and cartridge front end 27 are also removably connected by a body snap groove 28 while not in use. The body snap groove also holds a separation disk 29 in place.

The separation disk holds the main propellant load 30 separate from the internal air space 31 contained in the front of the cartridge. For optimal results, it is preferred that the internal air space 31 has a volume preferably representing from about 20 to about 100, more preferably from about 25 to about 75, and most preferably from about 30 to about 50% of the volume of the cartridge occupied by the propellant. The volume of the cartridge occupied by the propellant preferably ranges from about 5 to about 25, more preferably from about 7 to about 20, and most preferably from about 10 to about 15 cubic inches. The internal air space is necessary to control the peak propellant pressures developed as the propellant burns. Without the internal air space, the propellant burning could accelerate uncontrollably and the propellant could even detonate in the confined space. Such rapid burning or detonation is not suitable for penetrating cone fractures as the process is too abrupt to properly pressurize the desired fractures without creating undesirable fractures and/or crushing the material. The fines generated by such crushing could plug the fractures, thus preventing their proper pressurization by the propellant gases. The rapid burning can also rupture the HPB cartridge along the cartridge wall or at the end of the cartridge adjacent to the stemming bar, causing gas pressure to drop prematurely and/or thermal ablation damage to the bar.

Figure 16:
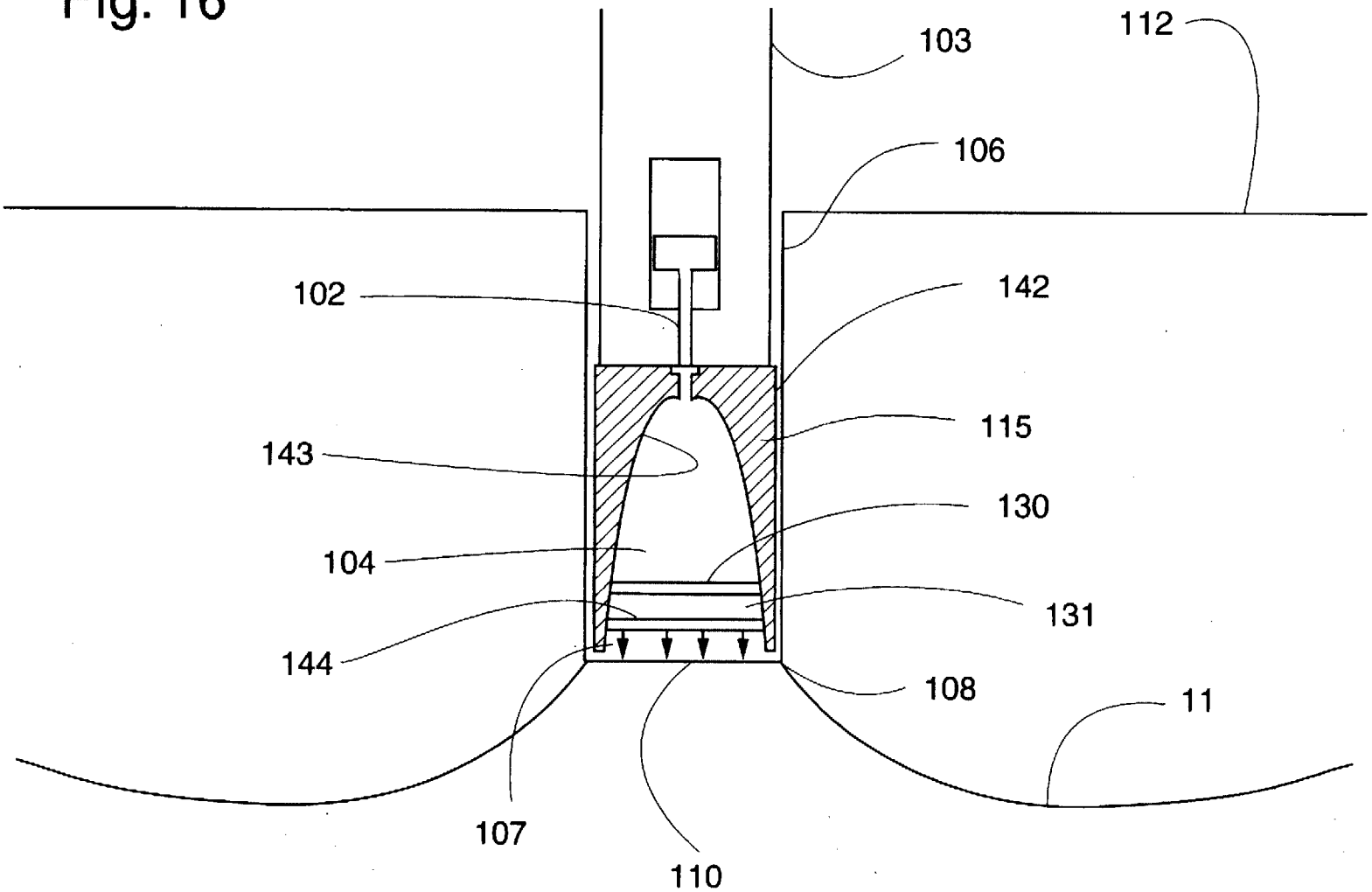
FIG. 16 shows an alternative cartridge configuration in which the internal wall is tapered to thicken the wall towards the base of the cartridge. The internal wall transitions to the interior of the base by a large radius so as to reduce the tendency to rupture prematurely from the combined action of the wall of the cartridge being pinned against the wall of the drill hole and the base of the cartridge following the recoil of the stemming bar.

The disk 29 is designed to rupture or disintegrate when the propellant is burned so that the hole bottom is exposed to high pressure gases. Alternatively, the cartridge can be manufactured as a molded part with the internal relief volume as an integral part of the cartridge as shown in FIG. 16. The downhole end of the relief volume would be designed with a thinner wall section or with burst grooves to ensure that it ruptures in a way to expose only the hole bottom to the initial gas pressure pulse. These gases can then cause a penetrating cone fracture or other controlled fracture to develop and the gases can then drive this fracture deep into the rock. A space between the closure disk 144 and the hole bottom 110 provides a volume into which the burning propellant can expand. This volume is important to the control of the peak propellant burn pressures and provides through control of the volume, the means to control the gas pressures applied to the material to be fractured and the cartridge. Gas pressures sufficient for controlled fracture development but below those which would rupture the cartridge can thus be attained in a controlled manner. The pressures thus developed are maintained below those which would deform or damage the end of the stemming bar and below those which would crush the rock around the hole.

At the cartridge front end 27, two or more shallow rupture grooves 32 are scribed to facilitate the rupture of the cartridge front end as the gas pressure builds up inside the cartridge during firing. These grooves ensure that the cartridge ruptures at the front end and not elsewhere along the cartridge body such as the location near where the cartridge body 25 enters the cartridge base 24.

The cartridge base 24 also contains a primer pocket 33 which is concentric with the axis of rotation of the cartridge. The primer pocket allows the igniter tube 34 to be inserted and seated into the position shown. Thereupon, the primer 35, which has a slightly larger external diameter than the diameter of the primer pocket, is pressed into the position shown.

The percussive or electrical or optical primer 35 is pressed into the primer pocket of the cartridge base and seats on the primer seating rim 36 of the igniter tube [12] 34.

The igniter tube 34 is a tube containing a number of flash holes 37 positioned in the walls of the igniter tube. The front end of the igniter tube may contain an igniter tube plug 38 or it may contain a light wad which can contain the igniter powder 39 before firing but allow flame to be injected into the front of the main propellant bed 30 during firing.

Figure 5A:
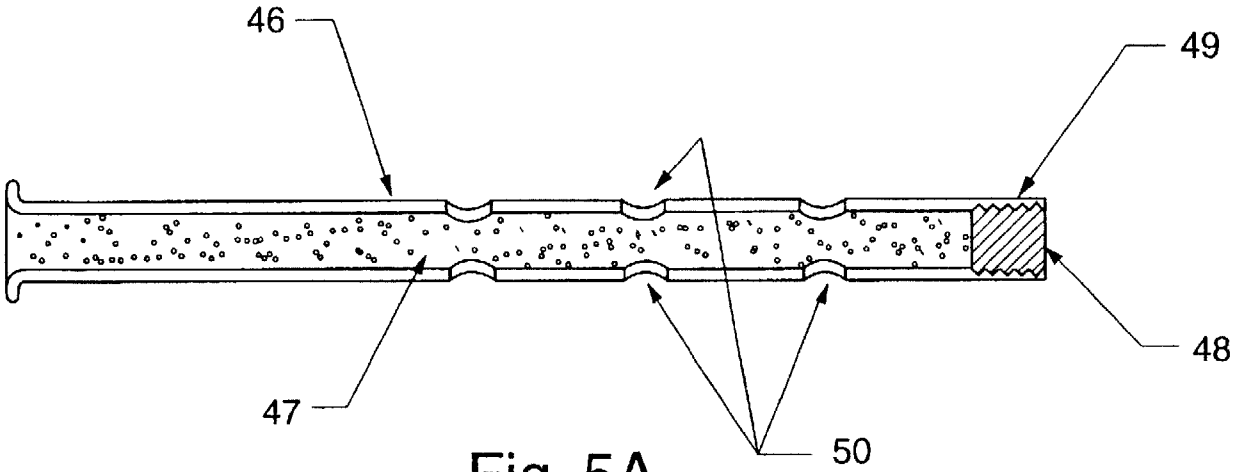
FIGS. 5A and 5B shows an igniter tube with an attached plug and an inertially light plug that is blown out by the igniter powder gases.
Figure 5B:
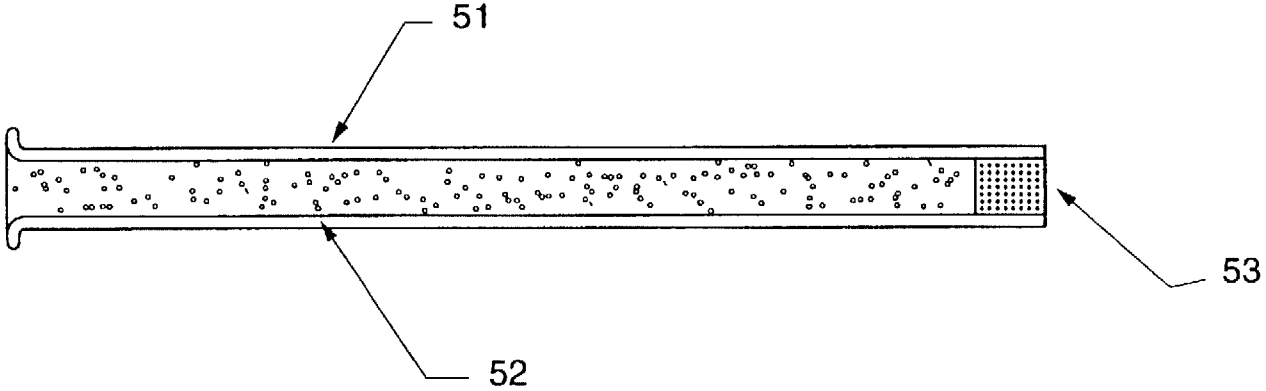
Figure 6D:
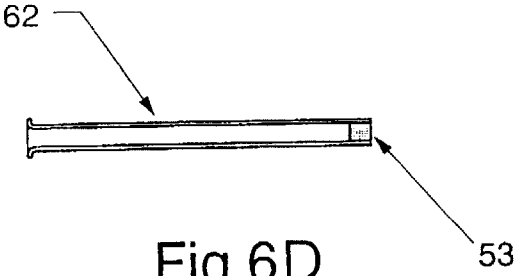
FIGS. 6A through F shows igniter tubes with different internal volumes, various lengths and with various distribution of flash holes.
Figure 6E:
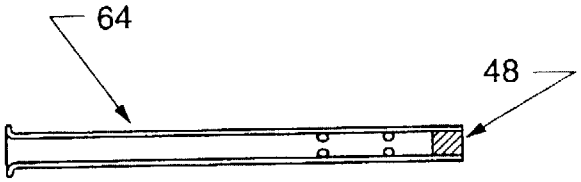
Figure 6F:
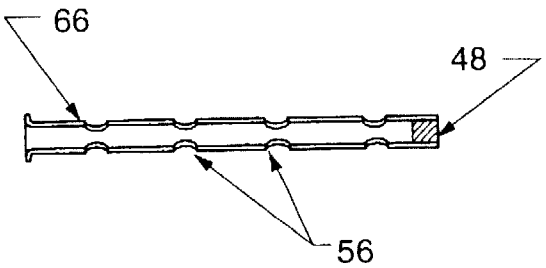
Figure 6A:
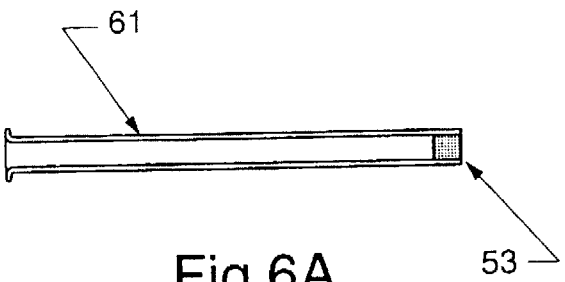
Figure 6B:
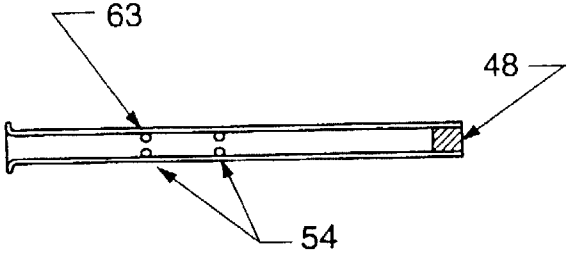
Figure 6C:
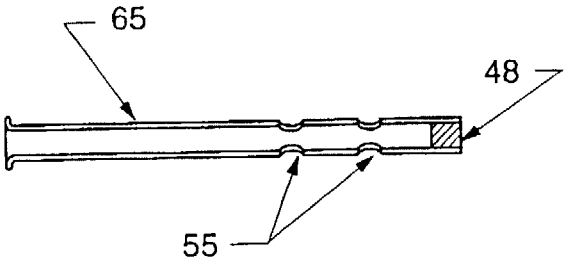

FIG. 5 shows a metal igniter tube 46 which has a metal plug 48 attached into the top of the igniter tube by threads 49. This plug prevents the gases from the igniter tube powder 47 from venting out the top end of the igniter tube and forces them to vent laterally out of the flash holes 50. Alternately, a metal igniter tube 51 has a light plug 53 or wad of cotton or wax pressed into the top end to retain the igniter tube powder 52 from spilling out of the igniter tube. The igniter tube may or may not have flash holes. The gases from the igniter powder can vent out of the top end of the igniter tube. If the igniter tube has flash holes, the igniter gases may vent laterally from the flash holes as well as from the top of the igniter tube.

FIG. 6 illustrates several designs of igniter tubes. Igniter tube 62 has a smaller internal diameter than igniter tube 61. Both are shown without flash holes and with light wads 53 in the top end. Igniter tube 62 will output a smaller igniter flame than igniter tube 61, which may be required to control ignition of a small web propellant with no coating of inhibitor. Igniter tube 64 is a shorter version of igniter tube 63. Both are shown with two sets of flash holes and attached end plugs. Varying the length of the igniter tube is a means to place the igniter flame in different locations of the main propellant bed. Igniter tubes 65 and 66 are both of the same dimensions but have a different distribution of flash holes. Igniter tube 65 will vent laterally near the top of the igniter tube, while igniter tube 66 will tend to vent laterally but uniformly over the length of the igniter tube. A firing pin (not shown) is used to fire the primer 35. The primer initiates the igniter tube powder 39 which in turn initiates burning of the main propellant bed 30.

The cartridge further includes a sealing member 128 disposed at the bottom of the cartridge base 24 to provide additional sealing and gas containment to the sealing and gas containment provided by the cartridge body. Any of several sealing techniques, such as V-seals, o-rings, unsupported area seals, wedge seals, and the like can be employed. The seals can be replaced each time a cartridge is fired or, preferably, the seals can be reusable. When the primary sealing is provided only by a stemming bar 41, the design of the cartridge can be simplified considerably. For example, additional sealing can be achieved by accelerating the stemming bar into the hole just before ignition of the propellant charge such that the inertia of the stemming bar into the hole provides additional forces against the displacement of the cartridge out of the hole and the consequent cartridge rupture and loss of high-pressure propellant gases.

Figure 4:
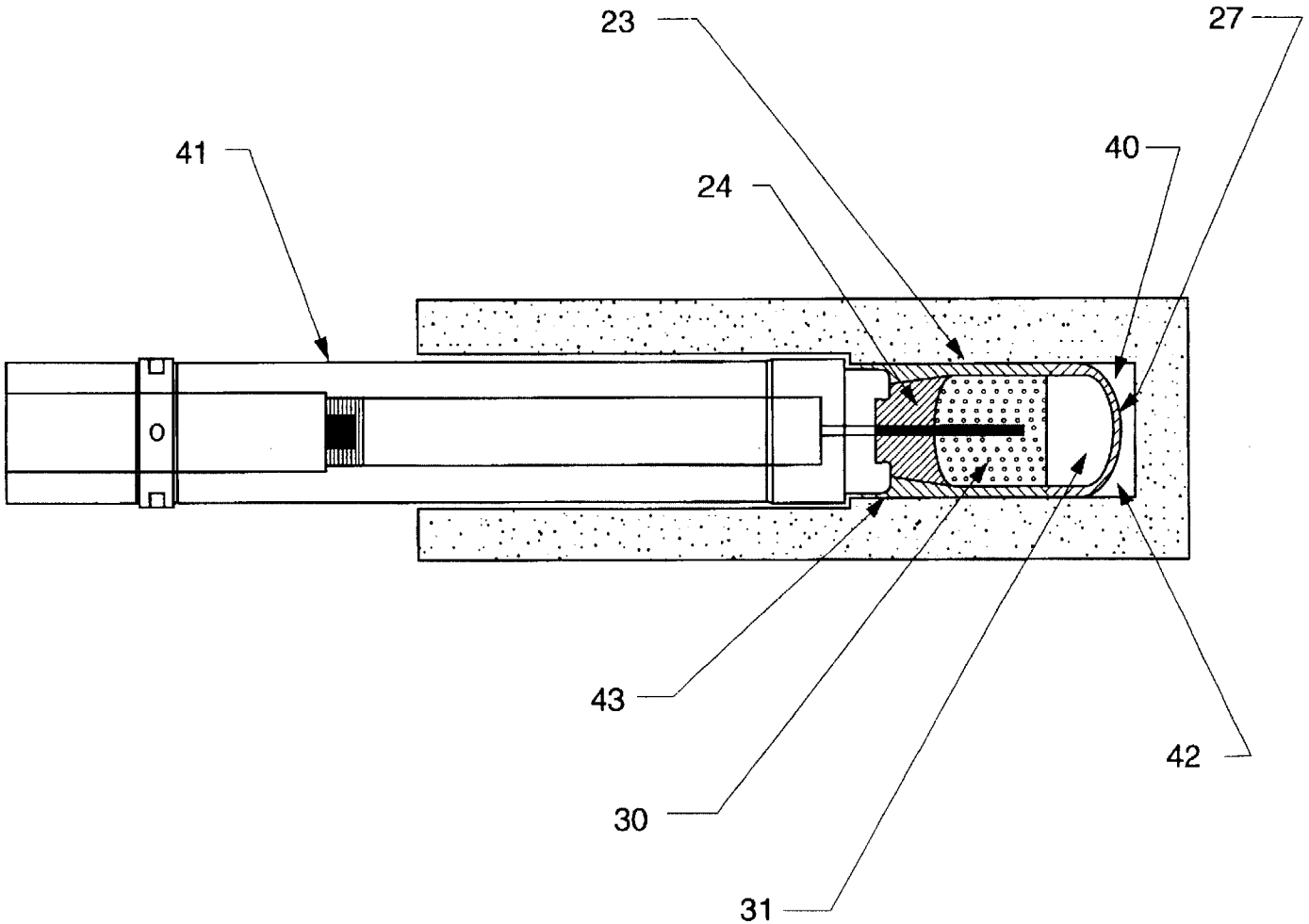
FIG. 4 shows a schematic sectional view of the cartridge of FIG. 3 inserted in the bottom of a drill hole by a heavy inertial stemming bar.

FIG. 4 shows a schematic sectional view of the cartridge for hole bottom 23 of FIG. 3 inserted in the bottom of a drill hole 40 by the heavy inertial stemming bar 41. The internal air space 31 in the cartridge contains sufficient volume to allow the main propellant load 30 to burn to a controlled peak pressure. Without this minimum additional volume, the volume provided only by the solid unburned propellant would not be sufficient to prevent an uncontrolled runaway burn or detonation of the propellant. There may be additional external volume 42 between the cartridge and the bottom of the hole. This volume may be filled with air, water or a combination depending on the drilling conditions and geology of the rock. This variability of this additional volume represents an uncontrolled condition with respect to the controlled burning of the main propellant load.

The cartridge for hole bottom 23 is fired in the position shown by a firing pin located in the stemming bar 41. As can be seen, the cartridge front end 27 has no confinement other than the front walls of the cartridge. Once the pressure inside the cartridge builds up to a small fraction (typically 2% to 10%) of the peak combustion chamber pressure, the front end of the cartridge body ruptures and there is no further significant confinement of the propellant gases during burning until they are reflected from the bottom of the drill hole 40. The propellant gases are prevented from escaping out of the closed volume formed by the cartridge and drill hole bottom by a dynamic sealing action provided by the walls of the cartridge body and the sliding cartridge base 24. If the walls of the cartridge body 25 rupture, a backup sealing ring 43 prevents or limits gas leakage past the stemming bar.

Figure 11:
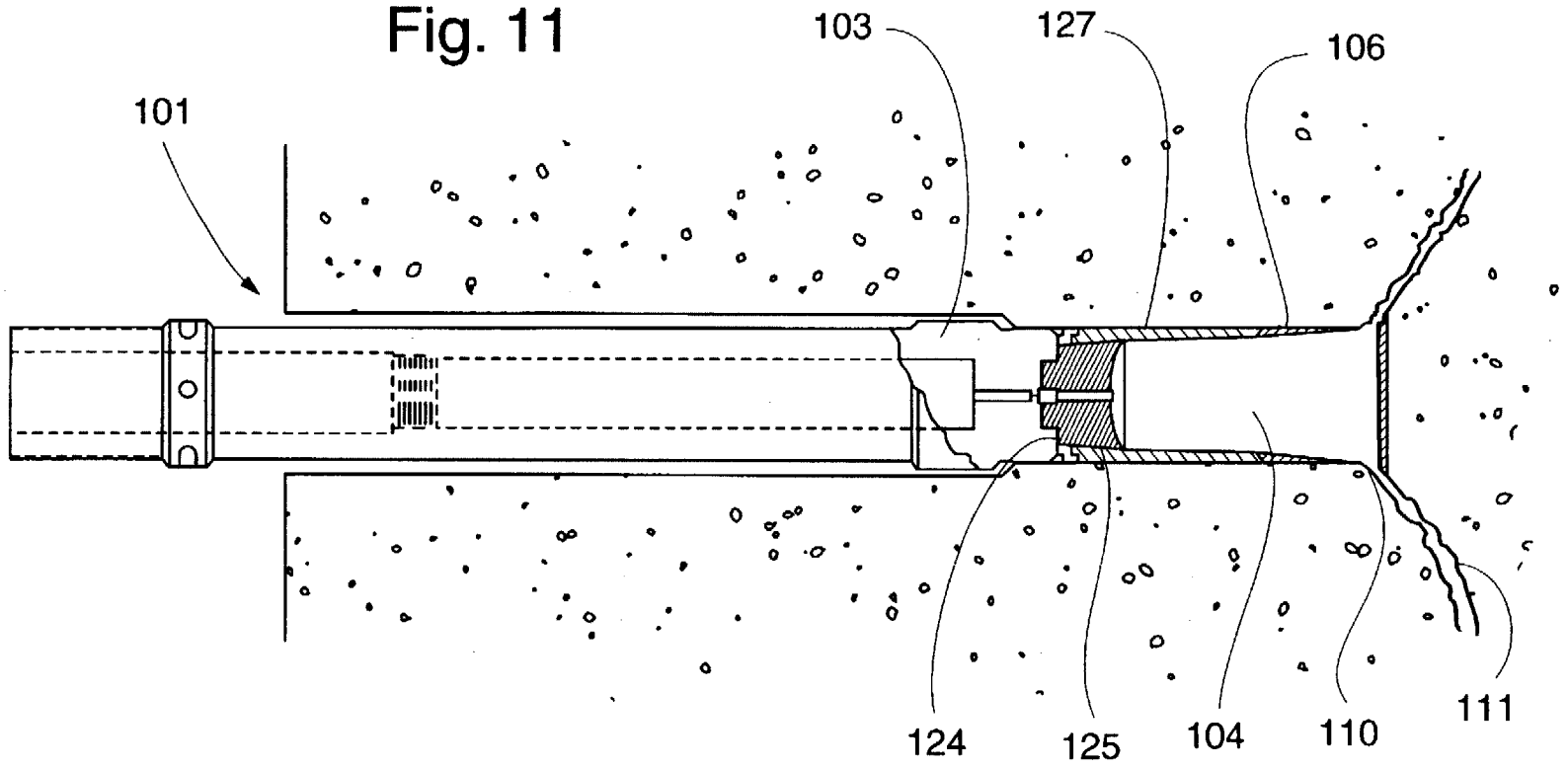
FIG. 11 is a cutaway view of the present HBP process after the propellant has been initiated showing the sealing action by the recoiling base plug of the HBP cartridge when the cartridge wall does not rupture near the end of the stemming bar.
Figure 12:
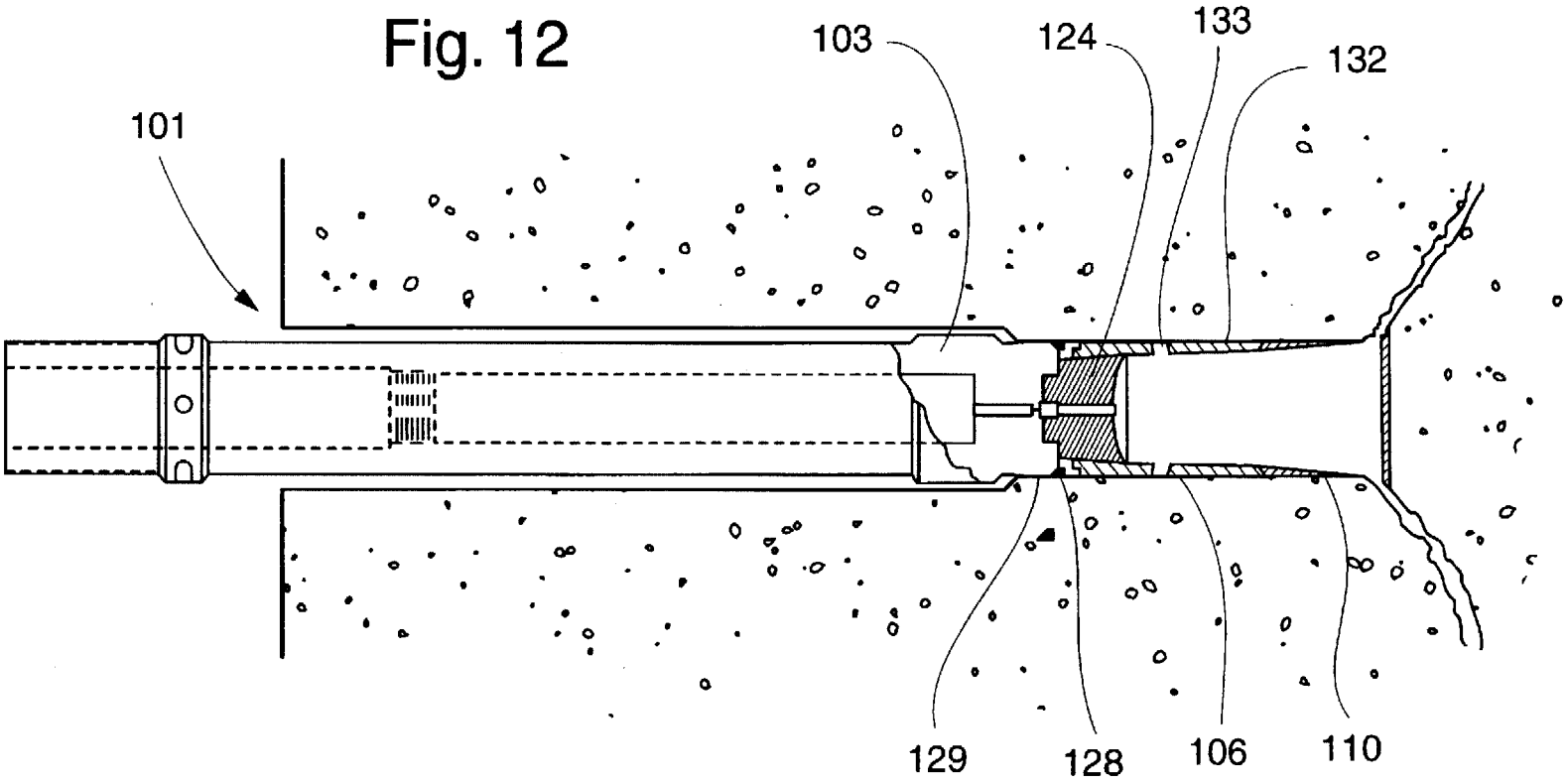
FIG. 12 is a cutaway view of the present HBP process after the propellant has been initiated showing the sealing action by the back-up sealing ring when the cartridge wall does rupture near the end of the stemming bar.

FIGS. 11 and 12 further illustrate the operation of an embodiment of an HPB cartridge. FIG. 11 illustrates a first case in which the tapered cartridge base 124 recoils with the stemming bar 103 and the walls of the cartridge 127 are held against the drill hole walls by the gas pressure. There is no leakage of propellant gases out of the rear of the cartridge. The separation disk which initially separates the propellant from the internal relief volume and the front end of the cartridge have been fragmented, and the hole bottom is exposed to the full gas pressure. In a second case shown in FIG. 12, the wall 132 of the cartridge body near the cartridge base 128 has been ruptured. The high pressure gas has forced some of the wall material and the steel back-up ring into the gap between the stemming bar and the walls of the drill hole to seal any further leakage of gas past the stemming bar 103. Otherwise the operation of the system is the same as in FIG. 11.

Figure 13:
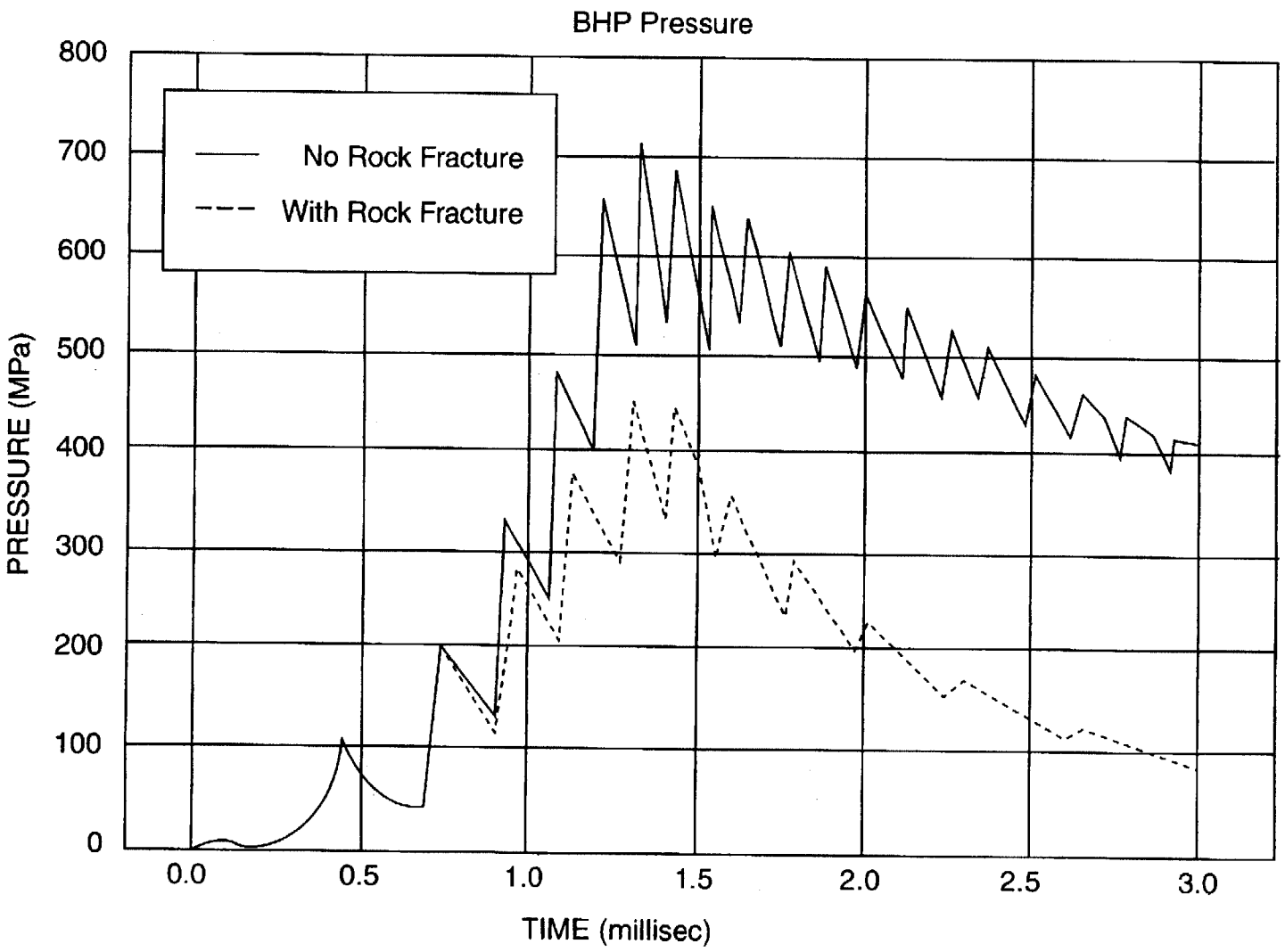
FIG. 13 illustrates a calculated pressure history for a hole-bottom pressure cartridge.

FIG. 13 illustrates a typical pressure history in the hole bottom after ignition of the propellant. This pressure history can be compared to the hole bottom pressure history of FIG. 7 for the injector method of inducing penetrating cone fractures. The pressure history in the HBP cartridge is much less dynamic than that in the injector cartridge. This is because the propellant gases in the HBP cartridge need only expand into the small relief volume at the bottom of the HBP cartridge and the pressure increases by small reflection pulses to a maximum of 400 MPa. In the injector cartridge, the propellant gases must expand down the injector barrel to reach the bottom of the drill hole. Through this expansion, internal energy is converted into kinetic energy over the length of the barrel. As a result, the gas pressure decreases and the gas velocity increases. When the high velocity, low-pressure gases encounter the bottom of the hole, kinetic energy is abruptly converted back to internal energy and the gas pressure rises abruptly. Pressure waves reflect back and forth in the barrel and hole bottom in a much more dynamic fashion than in the case of the HBP cartridge, causing much higher pressure transients.

Figure 9:
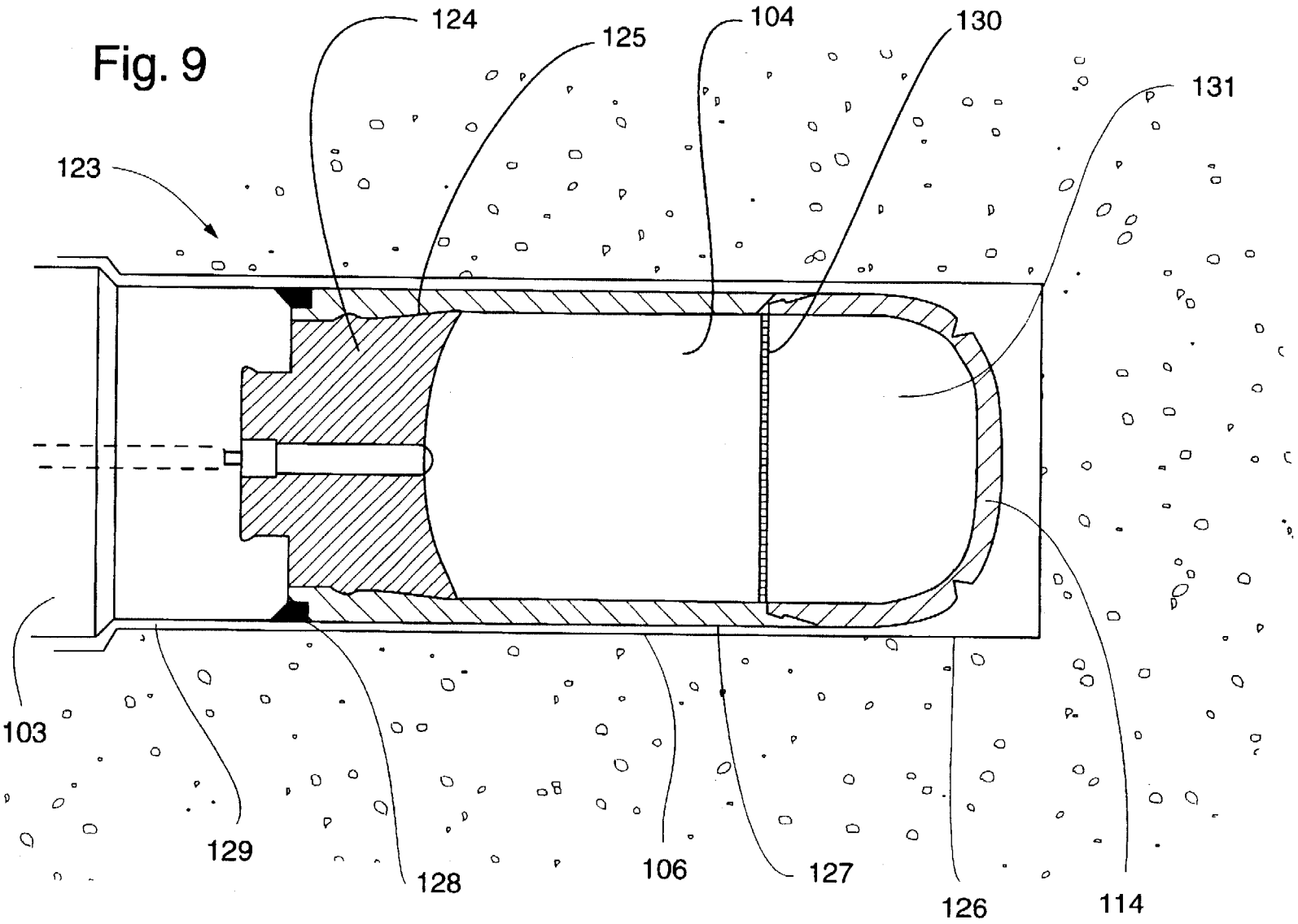
FIG. 9 is a cutaway close up side view of an HBP cartridge and stemming means showing the recoiling base plug design for sealing of the cartridge.
Figure 10:
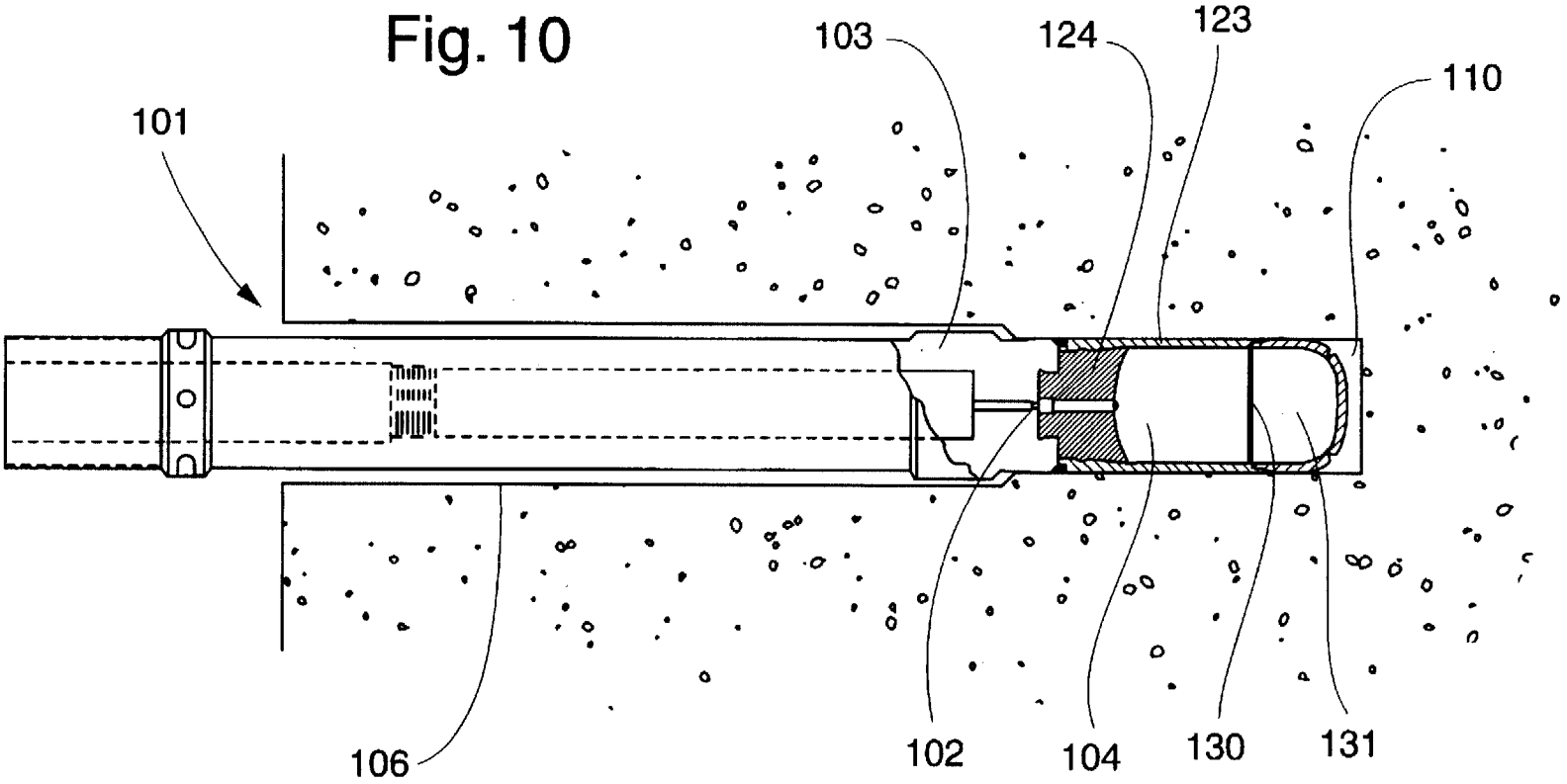
FIG. 10 is a cutaway view of the present HBP process showing the stemming bar and cartridge in the drill hole prior to initiating the propellant.

One of the main design criteria for the HBP cartridge is to provide proper sealing in the drill hole for the burning or burnt propellant gases under controlled burning conditions. The HBP cartridge may be designed to seal adjacent to the stemming bar, around the drill hole walls. This will prevent high-pressure gases from leaking between the stemming bar and the walls of the drill hole, and better contain the high-pressure propellant gases in the bottom of the drill hole. The HBP cartridge may also be designed to seal around the primer hole to prevent damage to the firing pin from the hot, high-pressure propellant products. A simple cartridge design with features to ensure proper drill hole sealing and containment of the propellant gases is shown in FIGS. 9 and 10. Through several field tests, it has been established that the HBP cartridge must have a combination of the proper geometry and the proper material properties to prevent premature cartridge rupture, which results in the premature loss of propellant gas pressure, which, in turn, reduces the effectiveness of the desired hole-bottom controlled-fracture process. The HBP cartridge design illustrated in FIG. 9 satisfies the general requirements by combining a tapered wall 125 and similarly tapered base plug 124, both of which tend to prevent the premature failure of the cartridge 123 near the cartridge base. Wall tapers in the range of 1 to 10 degrees are satisfactory, with tapers between 3 and 5 degrees being preferred.

The HBP and injector cartridge may be made from any tough and pliable material, including most plastics, ductile metals, and properly constructed composites. The HBP cartridge must be made of a material which can deform either elastically and/or plastically, with sufficient deformation prior to rupture to allow the cartridge containment to follow both the expansion of the drill hole walls and the recoil of the stemming bar during the rapid borehole pressurization and controlled-fracture process. The cartridges may also be made from a combustible or consumable material such as used in combustible cartridges occasionally used in gun ammunition. The preferred materials are those that will provide the required sealing and that can be made for the lowest cost per part.

Reusable HBP and injector cartridges can also be employed as noted above. In these, the end adjacent to the bottom of the drill hole would be consumed with each shot. The remainder of the cartridge must be recovered, reprimed, refilled with propellant and refitted with a new bottom disk to hold the propellant in the cartridge.

In the design shown in FIG. 9, a mechanical action is used to reduce some of the geometry and material property requirements of the first cartridge design. This HBP cartridge is constructed of a pliable sleeve 127 and basal sealing plug 124. The pliable sleeve is tapered to provide a greater resistance to premature rupturing of the HBP cartridge near its base and to provide an interference seal with the basal sealing plug, which is also tapered. The basal sealing plug can be constructed from any solid material, such as a plastic, a metal or a composite. The preferred materials are those that can be made for the lowest cost per part. The basal sealing plug contains the primer required to ignite the propellant charge.

The primer 102 fits into the cartridge at the end adjacent to the stemming bar. Its function is to initiate propellant burning when actuated by a command from the operator. Standard or novel propellant initiation techniques may be employed. These include percussive primers, where a mechanical hammer or firing pin detonates the primer charge; electrical primers, where a capacitor discharge circuit provides a spark to detonate the primer charge; thermal primers, where a battery or capacitor discharge heats a glow wire; or an optical primer, where a laser pulse initiates a light sensitive primer charge.

An alternate cartridge design is shown in FIG. 16. This cartridge design is of simpler construction than the cartridge design shown in FIG. 9. This alternate design satisfies the general sealing requirements by combining a tapered interior wall 143 and large internal radius at the base, both of which tend to prevent the premature failure of the cartridge near the cartridge base 142. Interior wall tapers in the range of 1 to 10 degrees are satisfactory, with tapers between 3 and 5 degrees being preferred.

Propellants rather than explosives are employed in the present invention. Propellants burn sub-sonically and pressure build-up is controlled by the propellant geometry; propellant chemistry; propellant loading density; ullage or empty space in the cartridge; and confinement of the cartridge/propellant system between the walls of the drill hole and the stemming bar. With this control, the bottom of the drill hole can be pressurized until a penetrating cone fracture or other controlled fractures are initiated along the line of maximum stress concentration on the perimeter of the hole bottom. The propellant gases then expand into the fracture(s) and drive the fracture(s) deep into the rock and/or to nearby free surfaces.

An explosive charge, on the other hand, would detonate which is a supersonic type of burning that generates strong shock waves. This would also pressurize the bottom of the drill hole but pressure build-up would be so abrupt that the rock around the borehole would excessively fractured and crushed. As a result, the fractured and crushed rock around the drill hole would allow the explosive product gases to escape prematurely and would consume energy in an undesirable mode. The amount of rock broken would be less than that from a hole-bottom controlled fracture or a PCF type of fracture pattern; there would be considerably more dust from the pulverized rock; and the broken rock flyrock, would be propelled away from the face at considerably higher throw velocities.

The propellants that would be used in the present invention may be in granular form or may be in single-grain solid form. These solid propellants may contain one or more of the following components:

nitrocellulose
nitroglycerine
nitroguanadine
black powder

The propellants may also have an oxidizing agent added to reduce the amount of carbon monoxide generated during combustion.

Liquid propellants can also be employed. These include LGP 1846 and its derivatives, the JP4/nitric acid system and any other liquid propellant that can be controllably initiated and burned. One of the main requirements for the propellant is low cost and high-production capacity.

This method of breaking soft, medium and hard rock as well as concrete has many applications in the mining, construction and rock quarrying industries and military operations. These include:

tunneling
cavern excavation
shaft-sinking
adit and drift development in mining
long wall mining
room and pillar mining
stopping methods (shrinkage, cut & fill and narrow-vein)
selective mining
undercut development for vertical crater retreat (VCR) mining
draw-point development for block caving and shrinkage stopping
secondary breakage and reduction of oversize
trenching
raise-boring
rock cuts
precision blasting
demolition
open pit bench cleanup
open pit bench blasting
boulder breaking and benching in rock quarries
construction of fighting positions and personnel shelters in rock
development of large holes or chambers for placing demolition charges
reduction of natural and man-made obstacles to military movement FIG. 9 shows an embodiment of an HBP cartridge 123, which incorporates a sliding plug 124 fitted within the conically tapered wall 125 of the cartridge. The propellant 104 is contained in the volume between the sliding base plug 124 and the propellant containment disk 130. An internal relief volume 131 is contained between disk 130 and the front of the cartridge 114 and has the function of providing a controlled volume for the burning propellant to expand into, thus preventing pressures that are too high for the apparatus or even a detonation of the propellant. When the stemming bar 103 inserts the cartridge 123 and bar 103 into the drilled hole 106, a small space 126 typically surrounds the cartridge and could provide an avenue for propellant gas loss and fracture pressure reduction. Upon ignition of the propellant 104, the cartridge 123 expands to provide a tight fit between its outer wall 127 and the bore hole 106 and the tapered sliding plug 124 is forced by the high-pressure propellant gases to move rearwards and continue to maintain contact against the tapered wall 125 during its recoil motion by the high gas pressure. Due to the tapered relation between the plug 124 and the inner wall 125, a seal is maintained at the base of the cartridge 123. Additional sealing action may be provided by the action of a backup metal sealing ring 128.

FIG. 10 shows the HBP system 101 positioned in a borehole 106 prior to firing. The cartridge base 124 is attached to the end of the stemming bar 103 for insertion into the bottom of the drill hole. A propellant ignition system 102 is located coaxially in the stemming bar and is used to strike the primer in the base 124 of the cartridge 123. A disk 130 is located in the cartridge to separate the propellant charge 104 from the relief volume 131. This internal relief volume provides the free volume required for the proper controlled burn of the propellant such that the HBP method may be used in either a gas-filled or a water filled hole 106. In a water-filled hole, the cartridge will displace most of the water from the hole bottom 110.

FIG. 11 shows the HBP system 101 after firing in the situation where the cartridge wall 127 does not rupture near the end of the stemming bar 103. This is the intended mode of sealing. The propellant 104 has been initiated and the pressures developed causes the stemming bar 103 and cartridge base plug 124 to recoil whilst expanding the cartridge walls 127 against the wall of the drill hole 106. The propellant containment disk has been fragmented causing the hole to fill with propellant gases initiating a controlled fracture 111 at or near the bottom of the drill hole 110. The pressure forces the taper of the base plug 124 against the taper of the cartridge wall 125 during recoil to maintain a dynamic seal while the rock breaking process occurs.

FIG. 12 shows the HBP system 101 after firing in the situation where the cartridge wall 132 ruptures 133 near the end of the stemming bar 103. This is not the intended mode of sealing but is a possible situation which is provided for in the present design. The cartridge wall 132 near the base plug 124 is assumed to have ruptured 133 and the high pressure propellant gases then force the metal back-up ring 128 into the gap 129 between the end of the stemming bar 103 and the wall of the drill hole 106, sealing the system against leakage of gas from the hole bottom 110.

Figure 8:
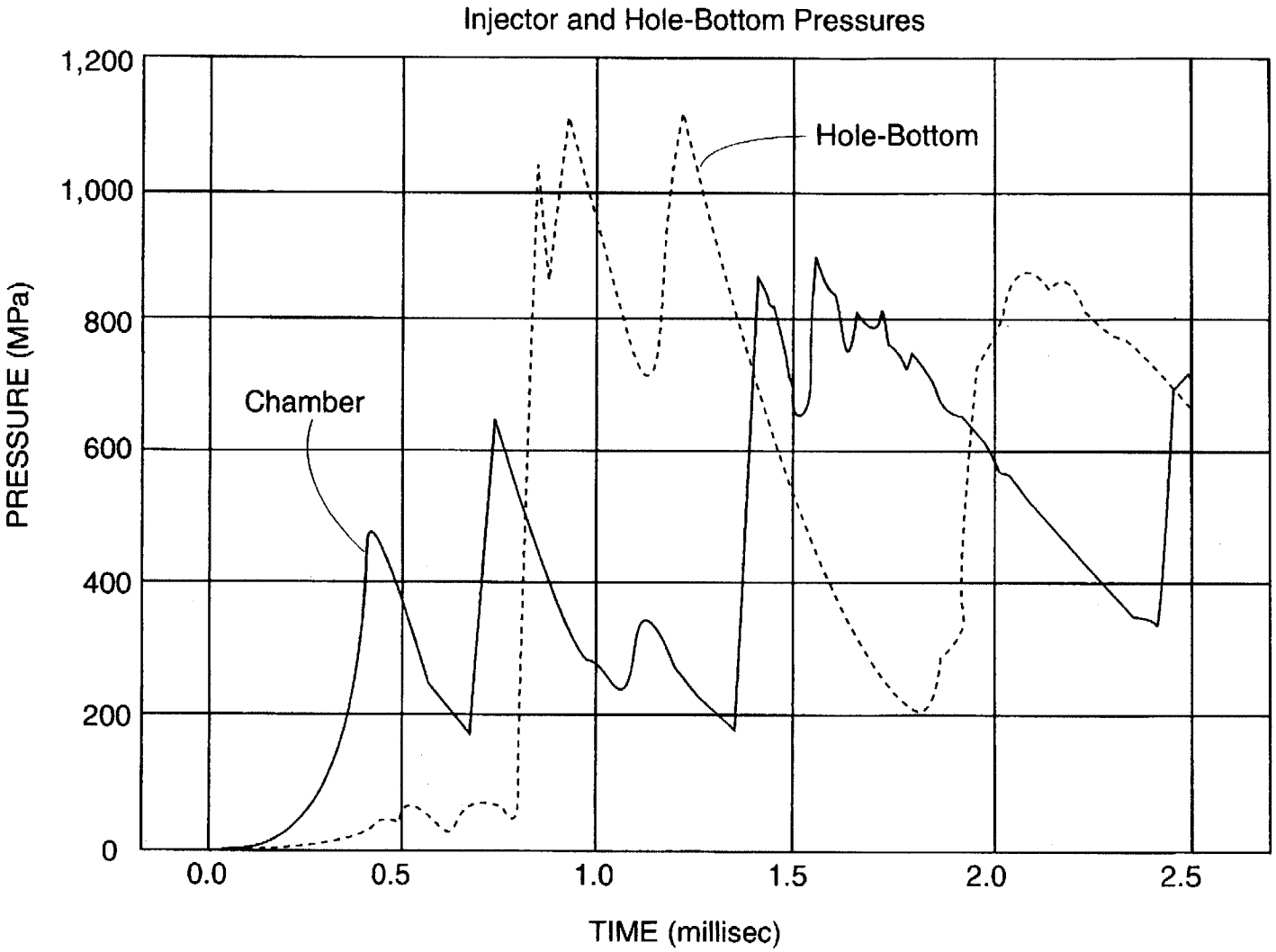

The performance of the HBP method is shown by the calculated pressure history illustrated in FIG. 13. The present HBP approach provides a more desirable hole and fracture pressurization which may be seen in comparison with FIG. 8. After initiation, the pressure builds up rapidly filling the relief volume 131 and entire bottom of the drill hole 110. If no gas leaks and no fractures develop, the pressure remains and will increase towards an equilibration pressure determined by the energy released, the volume available and the ratio of specific heats of the propellant products, but will not reach this state as a result of recoil motion of the stemming bar which may provide only inertial containment. Once a fracture is initiated or opened up, the gas pressure drops as the fracture is driven by the gas pressure.

Figure 14:
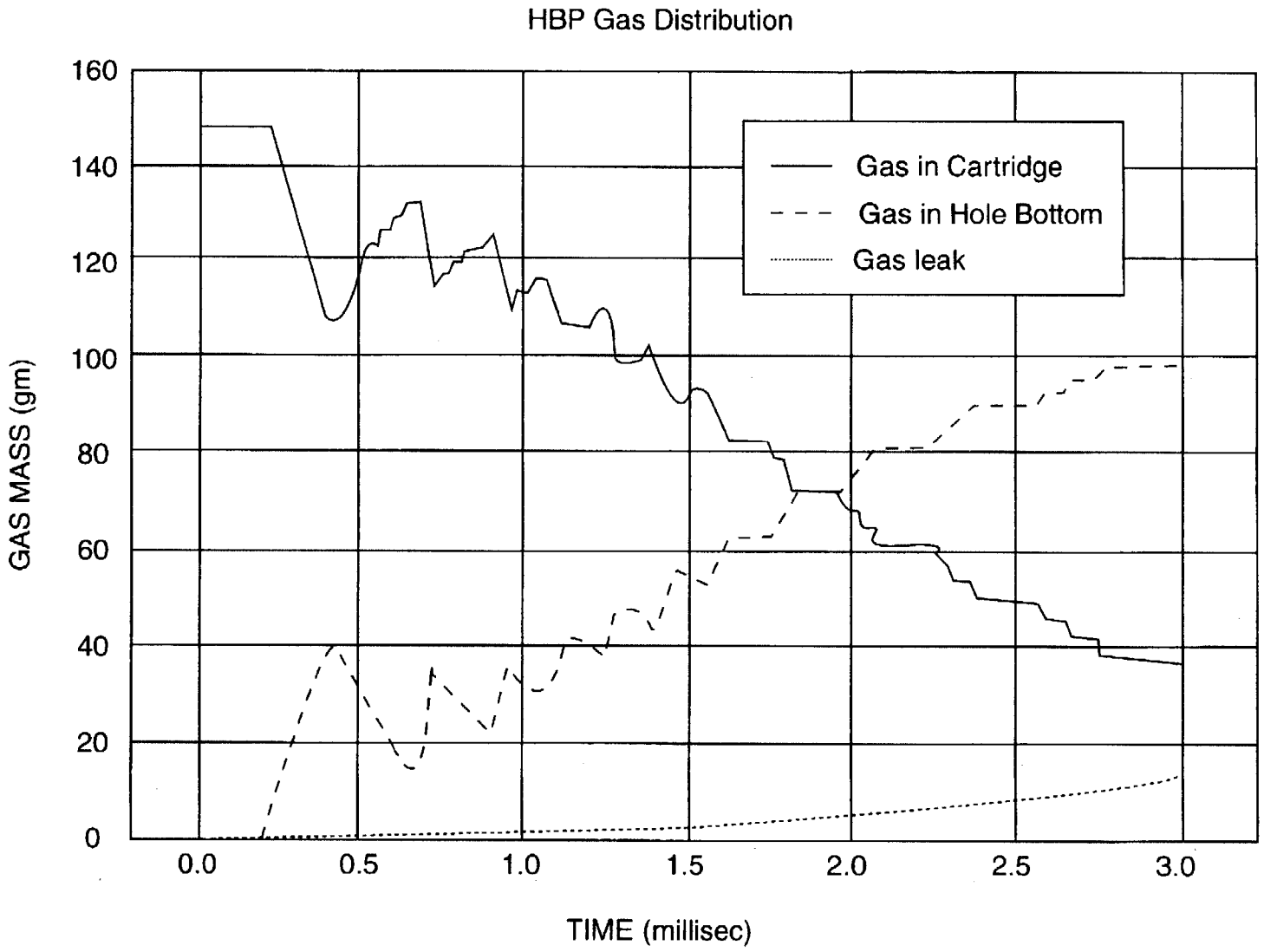
FIG. 14 shows the calculated gas distribution in the system during the HBP process where leakage occurs while fracture volume is opened up.

The calculated gas distribution within the HBP cartridge 123 and hole bottom 110 is shown in FIG. 14. Initially all the propellant 4 is contained within the volume closest to the stemming bar 103. After initiation, the propellant gases expand into the relief volume 131 and into the hole bottom 110. When the pressure reaches a critical threshold (on the order of 30% of the unconfined compressive strength of the rock), a penetrating cone fracture 111 is initiated. Gas continues to flow from the cartridge into the expanding fracture system. Concurrently, in this calculation, the cartridge wall 132 near the cartridge base plug 124 is assumed to rupture 133 and allow gas to leak through the gap 129 between the stemming bar 103 and the wall of the drill hole 106. The mass flow rate of gas is assumed to leak at the sonic choke condition which is dictated by the cross-sectional area of the gap 129 and the local gas sound speed and density. This calculation illustrates that, with no sealing action from the cartridge 123 or from a special sealing mechanism on the end of the stemming bar 103, the cross-sectional area of the stemming bar 103 is sufficient to prevent all but a small percentage of the high pressure propellant gases from escaping from the bottom of the hole 110 and the evolving fracture system.

Figure 15:
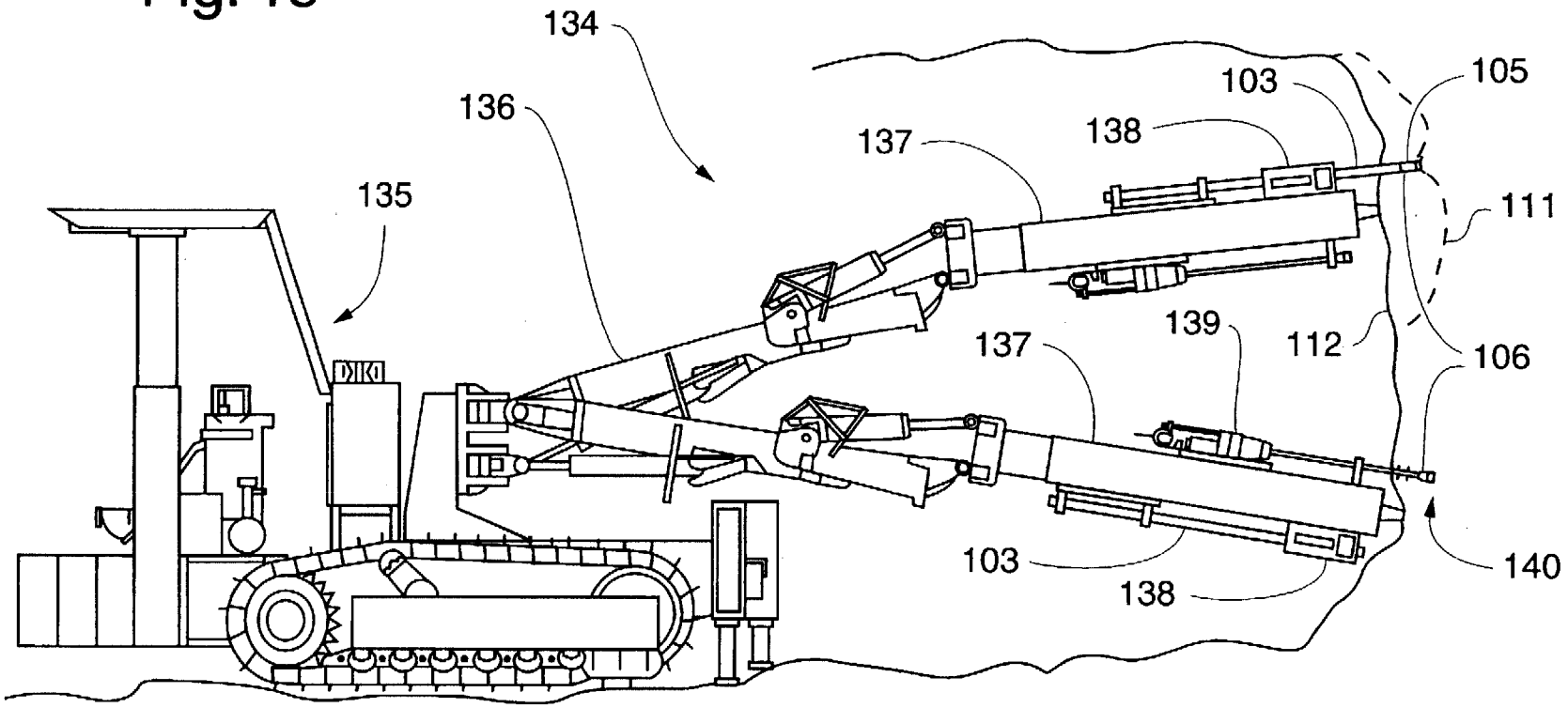
FIG. 15 shows the present invention in use with a typical carrier having plural booms, each boom comprising a means for drilling and then indexing the present hole-bottom pressure cartridge into the hole.

The present excavating system 134 shown in FIG. 15, has a conventional carrier 135 such as a tracked carrier, which has at least one boom. A preferred embodiment has two articulated booms 136, each with indexing extensions 137. Percussive drills 139 provide drilling 140 of boreholes 106. HBP autoloaders 138 are mounted on the indexing extensions 137. A high-inertia stemming bar 103 inserts, holds and stems a cartridge 105 to create penetrating cone fracture, or other hole-bottom controlled-fracture breakage 111 in the rock face 112. An autoloader 138 acts to place a propellant loaded cartridge 105 on the end of stemming bar 103 prior to insertion of the bar and cartridge into hole 106. To simultaneously drill and blast, both indexing extensions 137 are provided with drills, stemming bars and loaders. Cartridge loading by the autoloader and insertion and igniting the cartridge with one boom may occur while the other boom is drilling a new hole. The operation may be automatic. Once the operator selects a drill spot, drilling, indexing, loading and inserting automatically occur.

FIG. 16 shows the basic fracturing system of the present invention incorporating the stemming bar 103 abutting and backing an HBP cartridge 142 positioned in the borehole 106 drilled in the rock surface 112. The stemming bar 103 has a pneumatically, hydraulically or mechanically propellant ignition system 102 in the base of cartridge 142 for igniting the propellant charge 104. The propellant charge 104 is held within the cartridge by a propellant containment disk 130, providing an internal relief volume 131. The resultant propellant burning rapidly pressurizes the space between the cartridge closure disk 144 and the bottom of the borehole 110. The cartridge 142 has a large internal radius 143 in the base (preferably ranging from about 4.0 to about 8.0 inches), which, in conjunction with the internal tapered wall 115, inhibits cartridge rupture and directs propellant generated high-pressure gases downward against the hole bottom 110.

While the invention has been described with reference to specific embodiments, modifications and variations of the invention may be constructed without departing from the scope of the invention, which is defined in the following claims.

What is claimed is:

1. In a system for fracturing a material, including an elongated member for insertion into a hole in said material and a cartridge engaging said elongated member, the cartridge comprising:

a base member;

a body member connected to said base member to define a space for containing a propellant;

means for igniting said propellant located within said body member, wherein said igniting means ignites a sufficient amount of said propellant to produce a propellant burn rate ranging from about 20,000 to about 100,000 psi/millisecond; and means for sealing a surface of the cartridge to a surface of a hole in the material.

2. The system as claimed in claim 1, wherein said body member removably engages said base member to permit reuse of said base member.

3. The system as claimed in claim 1, wherein said body member ruptures at an internal gas pressure from ignition of said propellant ranging from about 400 to about 2000 psi.

4. The system as claimed in claim 1, wherein said igniting means is a tubular member having an interior space containing an explosive for igniting said propellant.

5. The system as claimed in claim 4, wherein said igniting means is located along a longitudinal axis of said cartridge and has a length ranging from about 10 to about 90% of the length of said cartridge.

6. The system as claimed in claim 4, wherein the volume of said igniting means ranges from about 0.044 to about 5.60% of the cartridge volume.

7. The system as claimed in claim 4, wherein said igniting means includes perforations along a length thereof.

8. The system as claimed in claim 7, wherein the distance between adjacent perforations ranges from about 0.060 to about 0.5 inches.

9. The system as claimed in claim 1, wherein a first portion of said cartridge contains said propellant and a second portion of said cartridge is a space, said space providing volume for expansion of a gas generated by ignition of said propellant.

10. The system as claimed in claim 9, wherein said first portion is separated from said second portion by an interior wall of said body member.

11. The system as claimed in claim 9, wherein said second portion has a volume ranging from about 20 to about 100% by volume of said first portion.

12. The system as claimed in claim 1, wherein said means for sealing comprises a tapered surface of said base member contacting a tapered surface of said body member to cause said cartridge to form a seal with a surface of the hole after ignition of said propellant.

13. The system as claimed in claim 12, wherein said tapered surface has a taper relative to a center axis of the cartridge ranging from about 1.5 to about 6.0 degrees.

14. The system as claimed in claim 1, wherein said means for sealing includes at least one of the following: a V-seal, an O-ring, an unsupported area seal, and a wedge seal.

15. A cartridge for fracturing a material, the cartridge being inserted into a hole in the material, comprising:

means for generating a gas;

a base member;

a body member connected to said base member to define a space for containing the means for generating a gas;

means for igniting said means for generating a gas; and means for sealing a surface of the cartridge to a surface of the hole.

16. The cartridge as claimed in claim 15, wherein the means for generating a gas is capable of producing a gas pressure in said hole that is at least 20% of the compressive strength of said material.

17. The cartridge as claimed in claim 16, wherein said gas pressure in said hole ranges from about 100 to about 400 MPa.

18. The cartridge as claimed in claim 16, wherein the gas generating means includes a propellant and said propellant comprises an oxidizing agent to control formation of carbon monoxide during ignition of said propellant.

19. The cartridge as claimed in claim 15, wherein said body member removably engages said base member to permit reuse of said base member.

20. The cartridge as claimed in claim 15, wherein a first portion of said cartridge contains said gas generating means and a second portion of said cartridge is a space, said space providing volume for expansion of a gas generated by ignition of said gas generating means.

21. The cartridge as claimed in claim 15, wherein said first portion is separated from said second portion by an interior wall of said body member.

22. The cartridge as claimed in claim 15, wherein said means for sealing comprises a tapered surface of said base member contacting a tapered surface of said body member to cause said cartridge to form a seal with a surface of the hole after ignition of said gas generating means.

23. The cartridge as claimed in claim 15, wherein said means for sealing includes at least one of the following: a V-seal, an O-ring, an unsupported area seal, and a wedge seal.

24. In a system for fracturing a material, including an elongated member for insertion into a hole in said material and a cartridge engaging said elongated member, the cartridge comprising:

means for generating a gas;

a base member;

a body member connected to said base member to define a space for containing the gas generating means; and means for igniting said gas generating means; and the system further comprising:

means for sealing the cartridge in the bottom of the hole, wherein the cartridge engages a downhole portion of the elongated member such that, when the elongated member is inserted into the hole, the cartridge is inserted into the hole with the elongated member.

* * * * *

UNITED STATES PATENT AND TRADEMARK OFFICE

Certificate

Patent No. 5,765,923 Patented: June 16, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John D. Watson, Evergreen, CO; Paul M. Krogh, Fremont, CA; and Young III, Chapman, Steamboat Springs, CO.

Signed and Sealed this Eleventh Day of May, 1999.

TAMARA L. GRAYSAY
*Supervisory Patent Examiner*
Art Unit 3672